US011584484B2

(12) United States Patent
Dombois

(10) Patent No.: US 11,584,484 B2
(45) Date of Patent: Feb. 21, 2023

(54) BIOMECHANICALLY ADAPTED SPORTSBOARD

(71) Applicant: Dombois Designs Inc., Stockton, CA (US)

(72) Inventor: Markus Dombois, Stockton, CA (US)

( * ) Notice: Subject to any disclaimer, the term of this patent is extended or adjusted under 35 U.S.C. 154(b) by 102 days.

(21) Appl. No.: 17/246,658

(22) Filed: May 2, 2021

(65) Prior Publication Data

US 2022/0348295 A1 Nov. 3, 2022

(51) Int. Cl.
*B63B 32/40* (2020.01)
*B63B 35/00* (2020.01)

(52) U.S. Cl.
CPC ..... *B63B 32/40* (2020.02); *B63B 35/00* (2013.01)

(58) Field of Classification Search
CPC ..... B63B 32/00; B63B 32/40; B63B 35/00; B63B 35/79; B63B 35/7926
USPC ..... 441/65, 74
See application file for complete search history.

(56) References Cited

U.S. PATENT DOCUMENTS

| | | | | |
|---|---|---|---|---|
| 3,337,886 | A | 8/1967 | Ekstrom | |
| 6,935,909 | B2 | 8/2005 | Mann | |
| 8,323,064 | B2 * | 12/2012 | Lessing | B63B 32/22 441/74 |
| 9,011,191 | B2 | 4/2015 | Connor | |
| 9,540,079 | B2 | 1/2017 | Wilbur | |
| 10,661,863 | B1 | 5/2020 | Gomez | |

* cited by examiner

*Primary Examiner* — Lars A Olson

(57) ABSTRACT

A biomechanically adapted dual direction sportsboard. This stance-specific sportsboard accommodates a rider's stance, whether they are a "regular-foot" or a "goofy-foot." This stance-accommodating dual direction sportsboard allows the rider much greater control since the board accommodates the specific biomechanics of the rider's dominant stance, whether their preference is to ride with their left foot in front or their right foot in front. The dual direction sportsboard has rails which are offset from each other, which allows for a rider with fixed foot positions to significantly change the trim of the board by shifting from heel-side rail to toe-side rail or back to heel-side rail. This provides the rider much greater control over the board while performing surfing-style maneuvers, especially with the board attached to their feet. Additionally, for kiteboarding, the offset rails allow for greater windward ability than with legacy designs.

11 Claims, 17 Drawing Sheets

BIOMECHANICALLY ADAPTED SPORTSBOARD

TECHNICAL FIELD

Figure 1A:
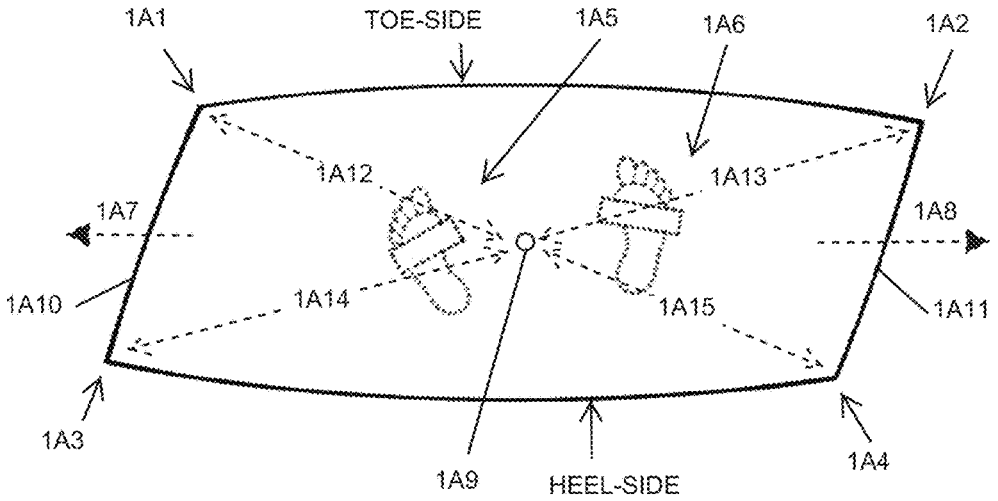

This disclosure generally relates to water-borne planing hulls as applied to aquatic devices such as sportsboards, designed to accommodate the rider's dominant stance.

BACKGROUND OF THE DISCLOSURE

When riding a sportsboard, riders need to shift the force of their weight to make different maneuvers. They need to lean forward at times, and lean back at times. They also need to engage the rails of the boards, because that is how a sportsboard is turned at speed. The rails are the outer edges of the board that run longitudinally. For example, to execute a toe-side carve maneuver on the toe-side rail of the board, and to fully engage the rail the rider must lean forward and over the toes of their forward foot, thereby transmitting the force of their weight onto the half of the board and its rail that is ahead of the forward or front foot and toes of the rider. This maneuver is akin to a "bottom turn" that a surfer makes on a wave.

Conversely when a rider wants to transition from a "bottom turn maneuver" to a "cutback maneuver," thereby executing a heel-side carve maneuver, the rider must lean back and transmit the force of their weight onto the heel-side rail and the half of the board that is behind the heel of the back foot. This maneuver is akin to a "cutback" that a surfer makes on a wave.

Legacy sportsboards, whether they are "directional boards," where the nose section is distinct from the tail section, as with surfboards, or with "dual direction boards," where the board is designed to be ridden in either direction wherein which end is the nose and which end is the tail is then determined by which direction the board is traveling. Unfortunately, these legacy sportsboards make no accommodation for the dominant stance of a rider; whether they are a left-foot-forward rider or a "regular-foot," or a right-foot-forward rider or a "goofy-foot." What is needed is a sportsboard design that accommodates the differing dominant stances of either a "regular-foot" or a "goofy-foot" rider, and thereby provides significantly greater control when the rider is executing the aforementioned maneuvers.

Moreover, these legacy approaches introduce yet additional problems to be solved. The design constraints inherent in the shaping of symmetrical legacy boards have been further reinforced because surfboard and sportsboard designers ("shapers") have been slavishly tied to a long history of symmetry in design for two reasons: 1) a need to conform their designs to work equally well for regular-foot riders as for a goofy-foot riders; and 2) amongst the relatively small and elite profession of surfboard shapers who still shape by hand, it has been, and still currently is, a matter of professional pride to shape a symmetrical board; since a lack of symmetry is indicative of a lack of shaping ability.

Additionally, shapers have worked to create surfboards adapted to different types of waves, and to different surfing styles. However, almost all legacy surfboard designs, and all legacy dual direction sportsboard designs, are constrained by the need to compromise under the mandates of symmetry.

Moreover, the fairly recent introduction of computer aided design and correlative computer-controlled milling machines to the profession of sportsboard shaping has exacerbated the legacy problem of reinforcing symmetry in sportsboard shaping. This is because precise computer controlled milling machines are replacing fallible human hands, and computers create precisely symmetrical shapes.

This further creates the additional problem to be solved, in that the increasingly ubiquitous use of these machines and computer aided designs has begun to replace the innate human creativity that flows from the hands of a shaper. Especially for the shaper who rides the sportsboards which he is sculpting, with the direct understanding of how the board will perform under circumstances that he has experienced; and through this experience has acquired the tactile knowledge of what works and what doesn't.

What is needed is a revolutionary design approach that breaks away from the long-held constraints and inherent limitations of symmetry. What is needed is a design approach which provides a framework within which a shaper may design a sportsboard that is more closely tailored to the biomechanical needs of the individual rider, thereby providing the rider with much greater control.

Additionally, a new problem in the sport of kiteboarding has emerged that is also in need of a solution. This is the need for greater control over a kiteboard while rapidly accelerating and carving through a turn. This new technique, developed by this author and coined by this author as "power looping," cannot be solved by legacy approaches.

Power looping is a method whereby a kiteboarder may generate tremendous power when transitioning from one direction to the other by creating a radical increase in the speed of the flow of "apparent wind" over the kite's surface. Apparent wind, as opposed to "true wind," is the wind that is created by an object's relative movement through the true wind. True wind is the actual, unadulterated speed of the wind over a relatively stationary surface area.

The application of apparent wind is now commonly demonstrated by very fast sailing craft like windsurfers, fast multihulls, hydrofoils and iceboats. Apparent wind enables high-speed wind driven vehicles to achieve much greater speeds than what speed the true wind is blowing.

Additionally, what makes the use of a traction kite unique among all other sailing craft, including the aforementioned high-speed sailing craft, is that the motive force of the kite is separate from the vehicle being moved, since the kite is actively being flown on lines. Thus, traction kites allow for much great power generation, even when the person flying the kite is stationary. This is because the power of the kite is directly related to the speed of the apparent wind that is crossing the airfoil or kite canopy. An easy way to understand this principle is to visualize a large propeller, and then visualize the kite as the surface near the tip of the propeller. Thus, the center of the propeller may remain relatively stationary while the propeller tip generates force.

An important additional consideration is that the ratio of the increase of wind-force to wind-speed, is exponential and not linear. Thus, a wind of twenty knots generates considerably greater force than merely twice the force of a breeze of ten knots. Additionally, a traction kite can go from a stationary position directly above the kiteboarder to a tremendous speed in a matter of a moment, especially when it is accelerated by gravity.

Figure 15:
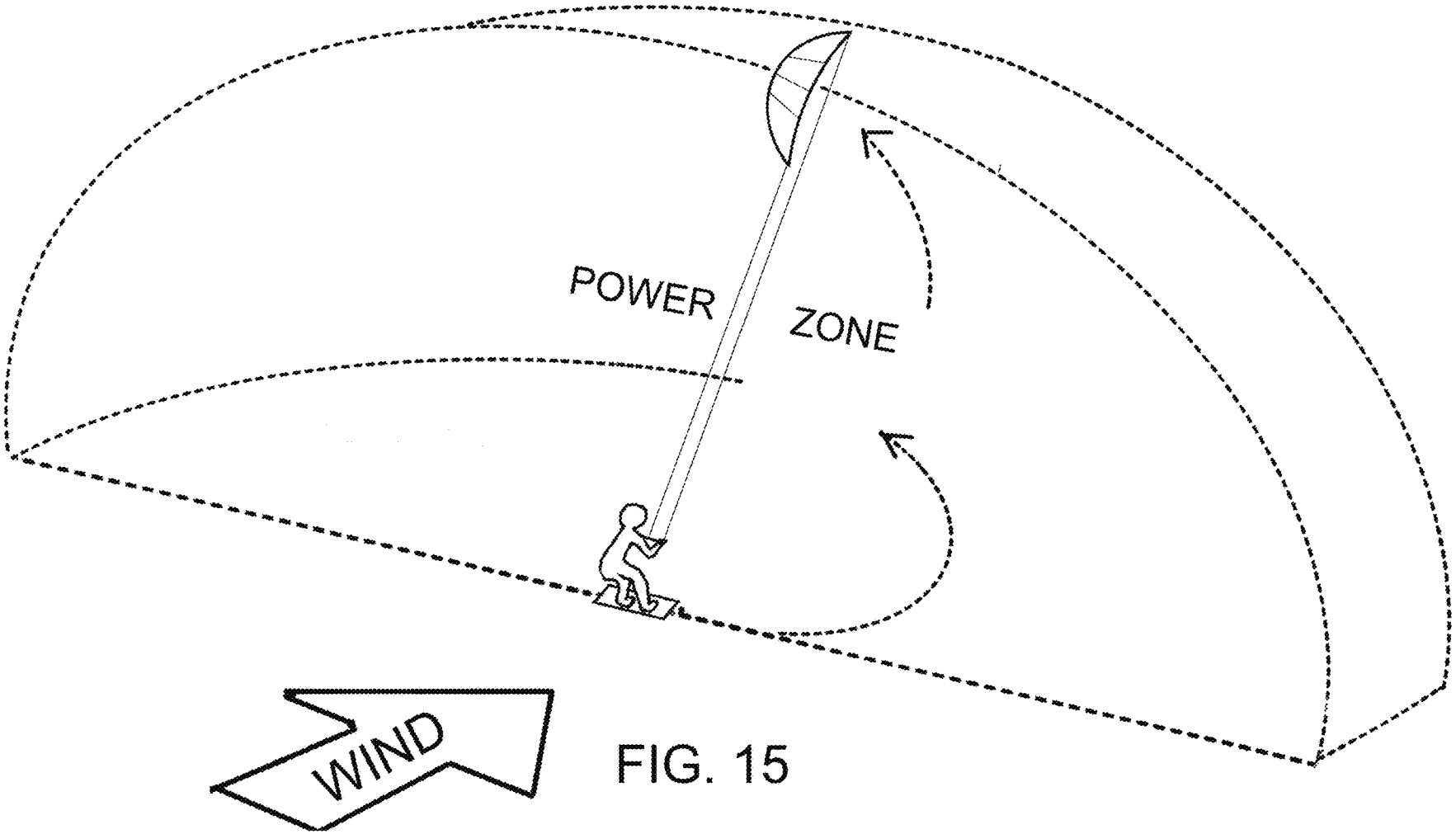
Figure 16:
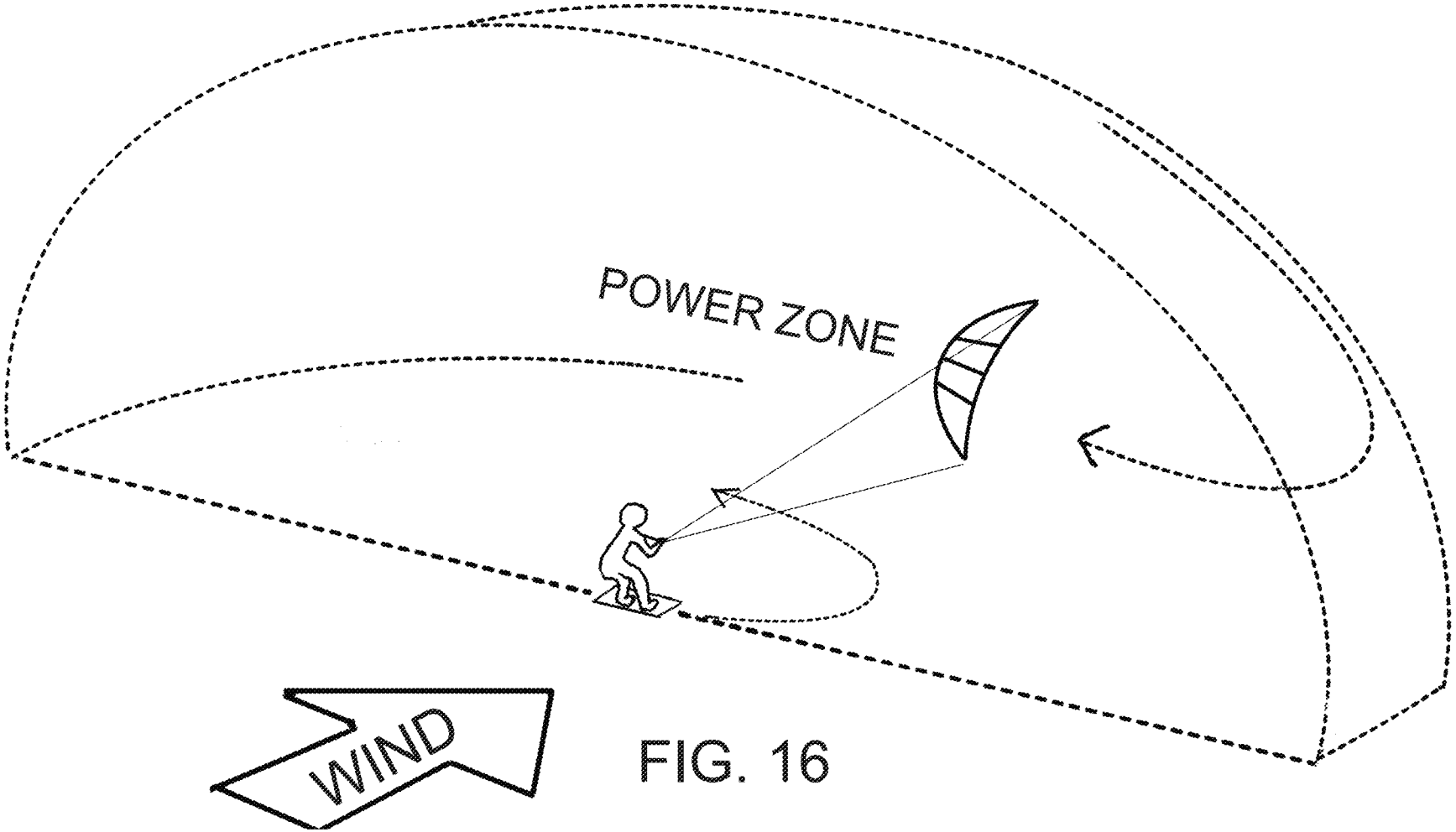

Another principle to understand is that a traction kite can only be flown within a "wind window" which is the half-sphere area within which a traction kite can be flown (e.g. see FIGS. 15 and 16). The size of a given wind window is determined by the length of the flying lines. The "power zone" is a zone that is horizontal to the water and along the base of the half-sphere of the wind window that is downwind from the kiteboarder. When the traction kite is flown across the power zone, the kite is close to perpendicular from the kiteboarder, and thus at an angle of about ten degrees off the surface. Most kiteboarders fly their kites at about a forty-five-degree angle, to avoid the power zone which otherwise puts the kite perpendicular to the force of the wind, and thus allows the full spread of the kite's canopy to generate force.

The traditional legacy method of performing a kiteboarding transition, when a kiteboarder jibes from one tack to the other, is done by flying the kite upwards and then in the opposite direction (e.g. FIG. 15). Since most kiteboarders generally fly their traction kites at about a forty-five-degree angle, the kite is already relatively high in the air, but gravity will slow the kite down and provide for a slower speed in the transition.

However, to perform a power loop: instead of flying the kite up and then overhead against the slowing forces of gravity (e.g. FIG. 16), the kiteboarder swoops the kite from on high towards the water's surface, thereby rapidly accelerating the kite and creating an exponential increase in apparent wind force; and then, just before impact, the kiteboarder pivots the kite to fly horizontally across the "wind window" and through the power zone from one side of the wind window to the other (e.g. FIG. 16), while at the same time performing a carving turn on the rail of the kiteboard.

Another way to perform a power loop can be done by flying the kite more horizontally across the water, and then instead of just using the control bar to steer the kite, the author grasps one of the steering lines near the bar with one hand and pulls on the line, which makes the kite rapidly pivot before it shoots across the wind window through the power zone. Grasping the lines like this is considered heretical to most kiteboarders. However, this technique allows the author to actually control the pivot speed of the kite and momentarily also decrease its power by reducing the speed of the apparent wind that is flowing across the canopy, before the tremendous surge of power that comes from flying the kite across the power zone. This momentary decrease in power is accomplished when the directional flow of the apparent wind across the canopy is interrupted when the kite is pivoted on its own axis.

Of additional consideration while power looping is that the forward movement of the rider adds to the apparent wind that is generated as the rider swoops the kite forward and towards the water. This is the opposite of what occurs when a rider performs a traditional transition wherein the kite is flown upwards and away from the direction of travel.

To emphasize the tremendous power generated by "power looping," the movement and power of the kite can be compared to what is commonly known in kiteboarding as an accidental "death looping." Death looping occurs when a kiteboarder loses control over their traction kite and the kite loops uncontrollably through the air while dragging the unfortunate kiteboarder behind it. The name "death loop" is well deserved, because quite a few kiteboarders have lost their lives because their kites were death looping while they failed to release the kite before it dragged them into an immovable object.

In sum, what is needed for aggressive carving and especially for the new technique of power looping is a dual directional sportsboard that offers greater control than what the legacy designs provide.

BRIEF DESCRIPTIONS OF THE DRAWINGS

The drawings described below are for illustration purposes only. The drawings are not intended to limit the scope of the present disclosure. This patent application file contains at least one drawing executed in color. Copies of this patent or patent application publication with color drawings will be provided by the U.S. Patent and Trademark Office upon request and payment of the necessary fee.

FIG. 1A presents an exemplar of the present disclosure that accommodates the stance of a regular-foot rider, according to some embodiments.

Figure 1B:
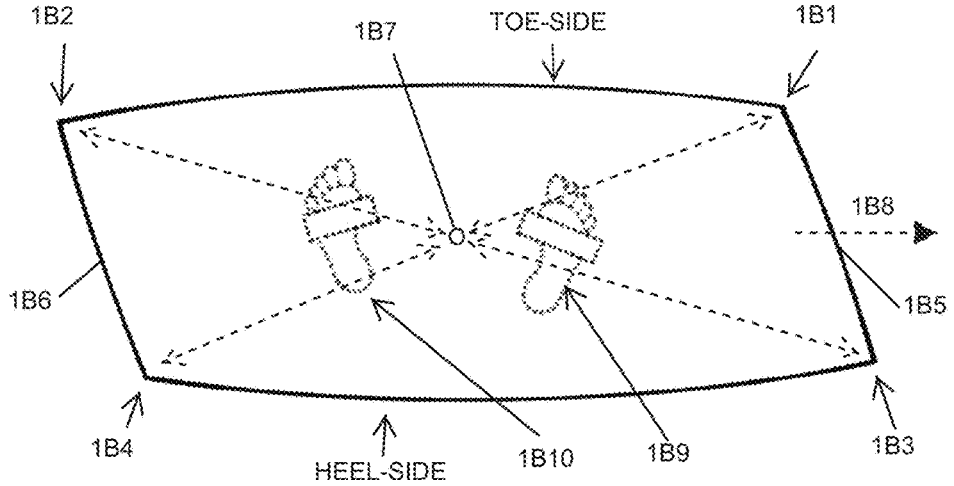

FIG. 1B presents an of the present disclosure that accommodates the stance of a goofy-foot rider, according to some embodiments.

Figure 1C:
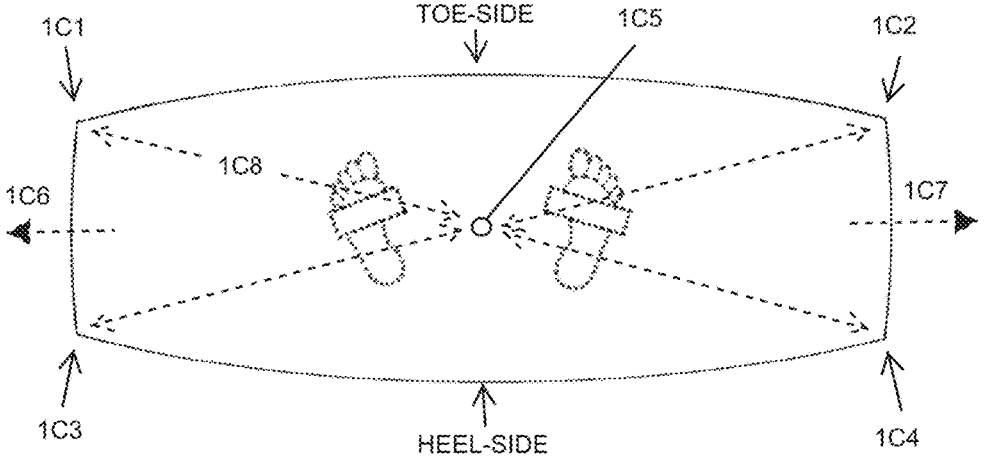

FIG. 1C presents an exemplar of a legacy dual direction sportsboard, according to some embodiments.

Figure 2A:
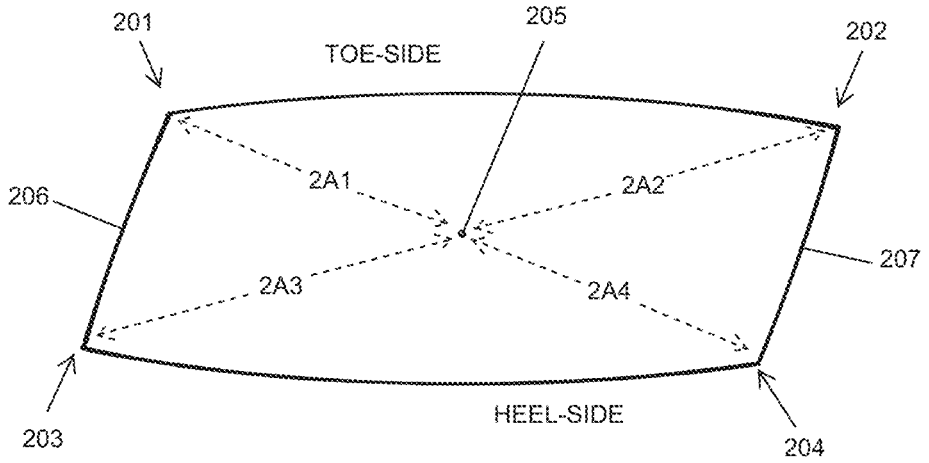

FIG. 2A presents an exemplar of the present disclosure that accommodates the stance of a regular-foot rider.

Figure 2B:
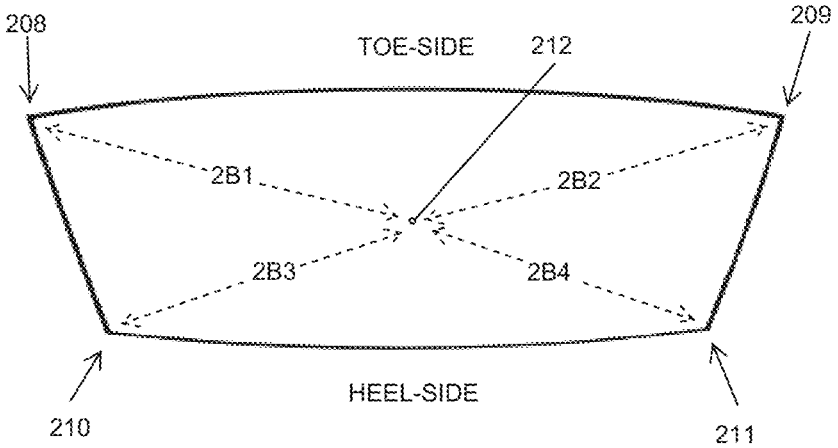

FIG. 2B presents an exemplar of an asymmetrical legacy kiteboard, according to some embodiments.

Figure 2C:
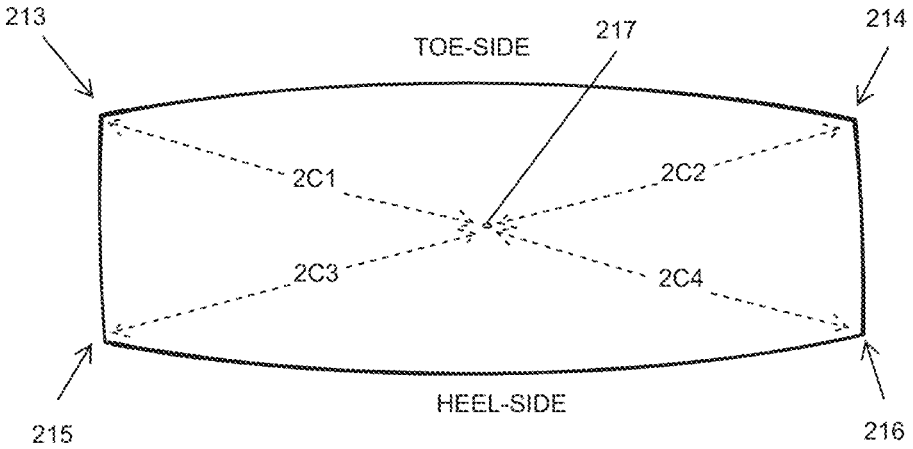

FIG. 2C presents an exemplar of a legacy dual direction sportsboard, according to some embodiments.

Figure 3A:
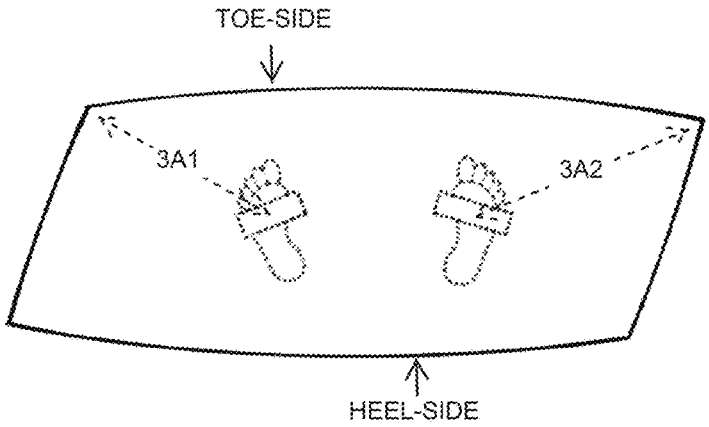

FIG. 3A presents an exemplar of the present disclosure that accommodates the stance of a regular-foot rider, according to some embodiments.

Figure 3B:
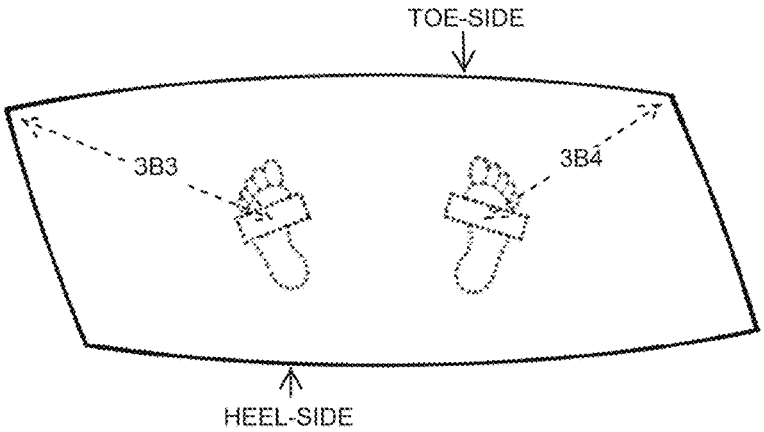

FIG. 3B presents an exemplar of the present disclosure that accommodates the stance of a goofy-foot rider, according to some embodiments.

Figure 3C:
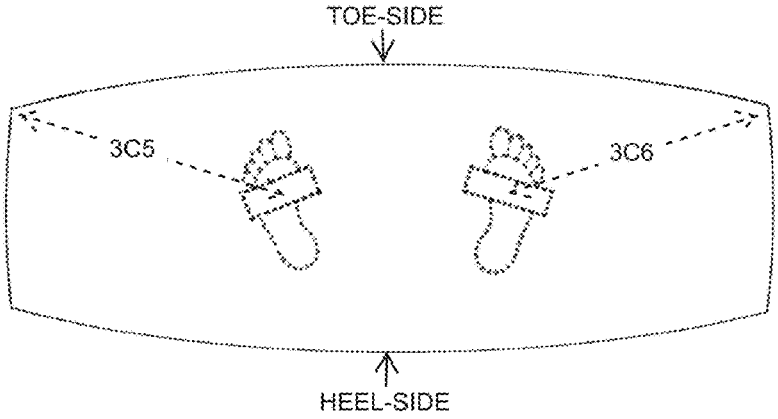

FIG. 3C presents an exemplar of a legacy dual direction sportsboard, according to some embodiments.

Figure 3D:
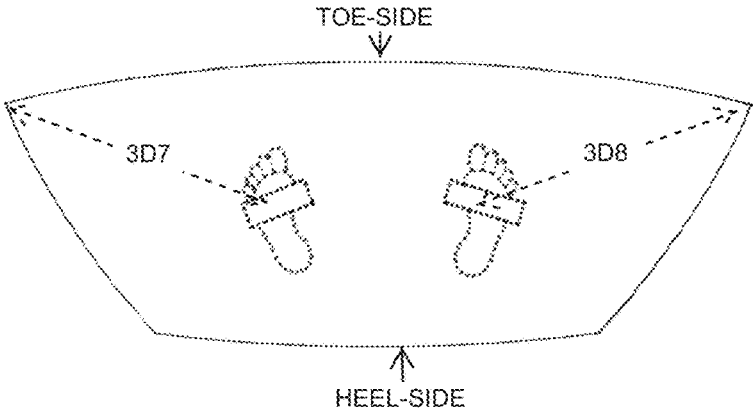

FIG. 3D presents an exemplar of a legacy asymmetrical dual direction sportsboard, according to some embodiments.

Figure 4A:
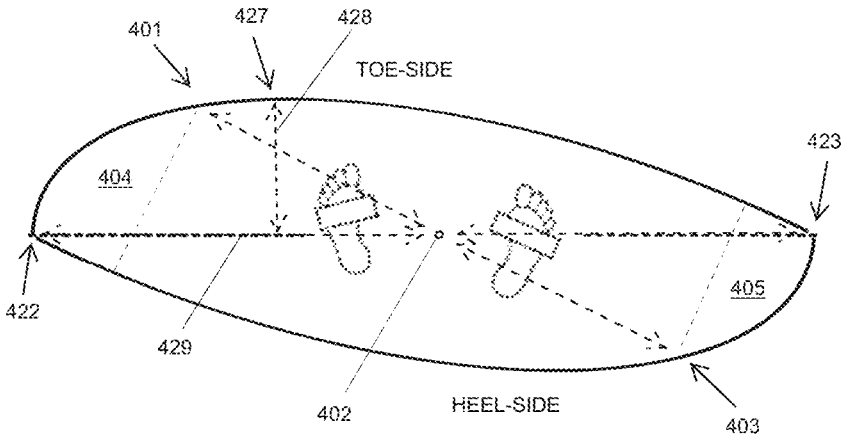

FIG. 4A presents a curvilinear version of an exemplar of the present disclosure that accommodates the stance of a regular-foot rider, according to some embodiments.

Figure 4B:
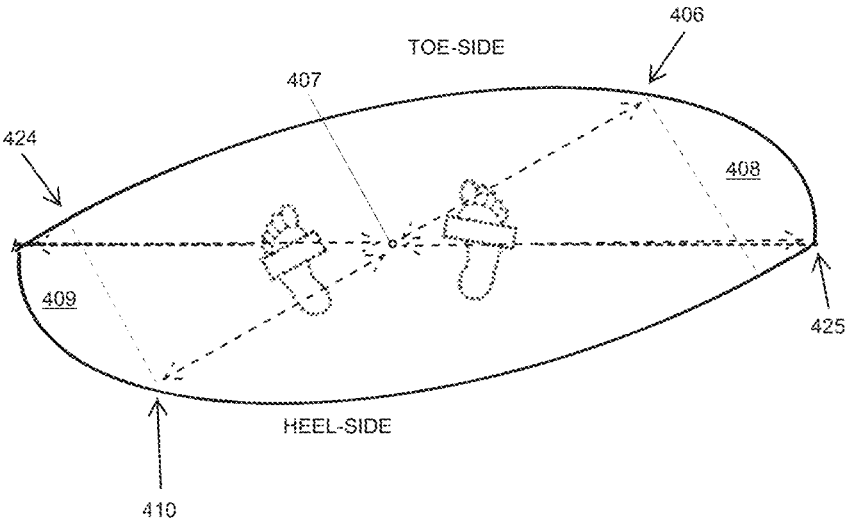

FIG. 4B presents a curvilinear version of an exemplar of the present disclosure that accommodates the stance of a goofy-foot rider, according to some embodiments.

Figure 4C:
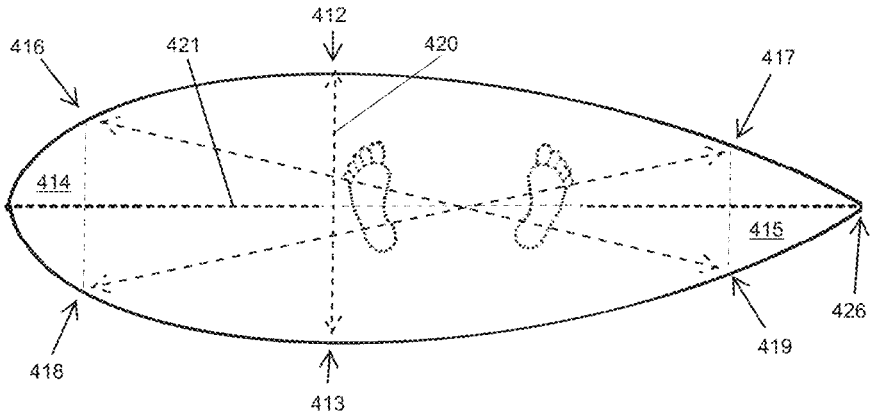

FIG. 4C presents an exemplar of a legacy pintail surfboard, according to some embodiments.

Figure 5A:
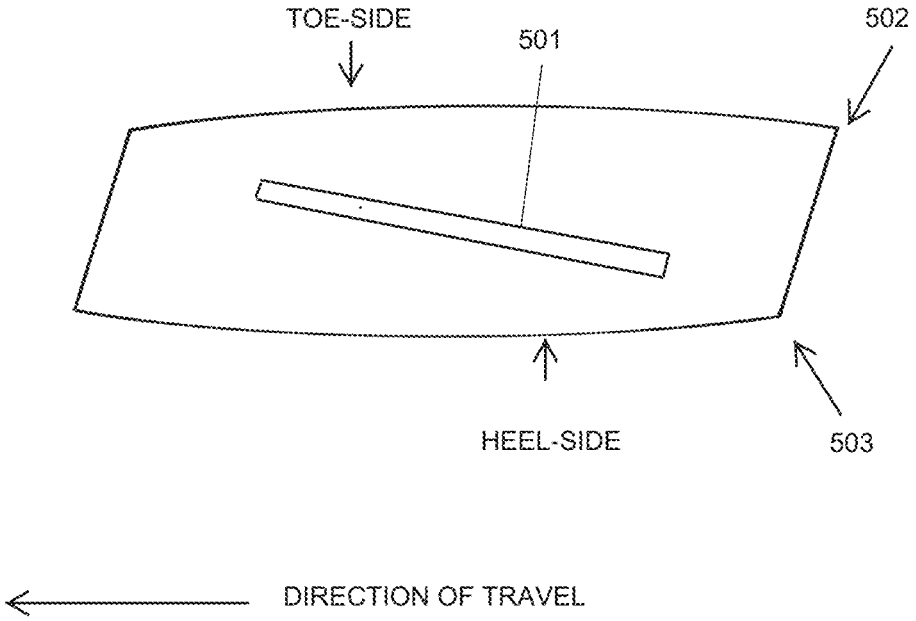

FIG. 5A presents an exemplar of a method of construction of the present disclosure that provides a specific flex or twist pattern that accommodates the stance of a left-foot forward rider, according to some embodiments.

Figure 5B:
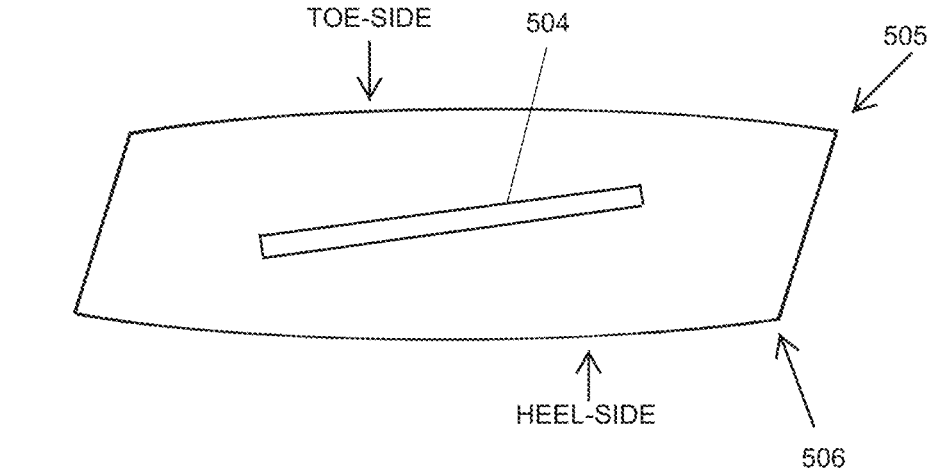

FIG. 5B presents an exemplar of a method of construction of the present disclosure that provides a specific flex or twist pattern that accommodates the stance of a left-foot forward rider, according to some embodiments.

Figure 6A:
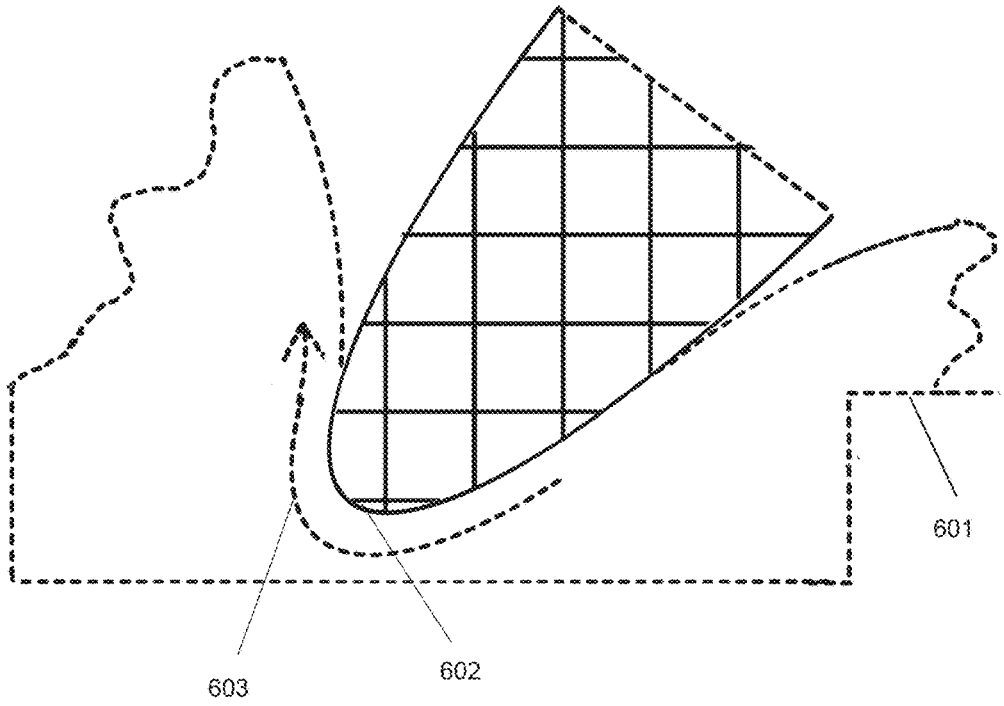

FIG. 6A presents an exemplar of a soft, 50/50 rail of the present disclosure, according to some embodiments.

Figure 6B:
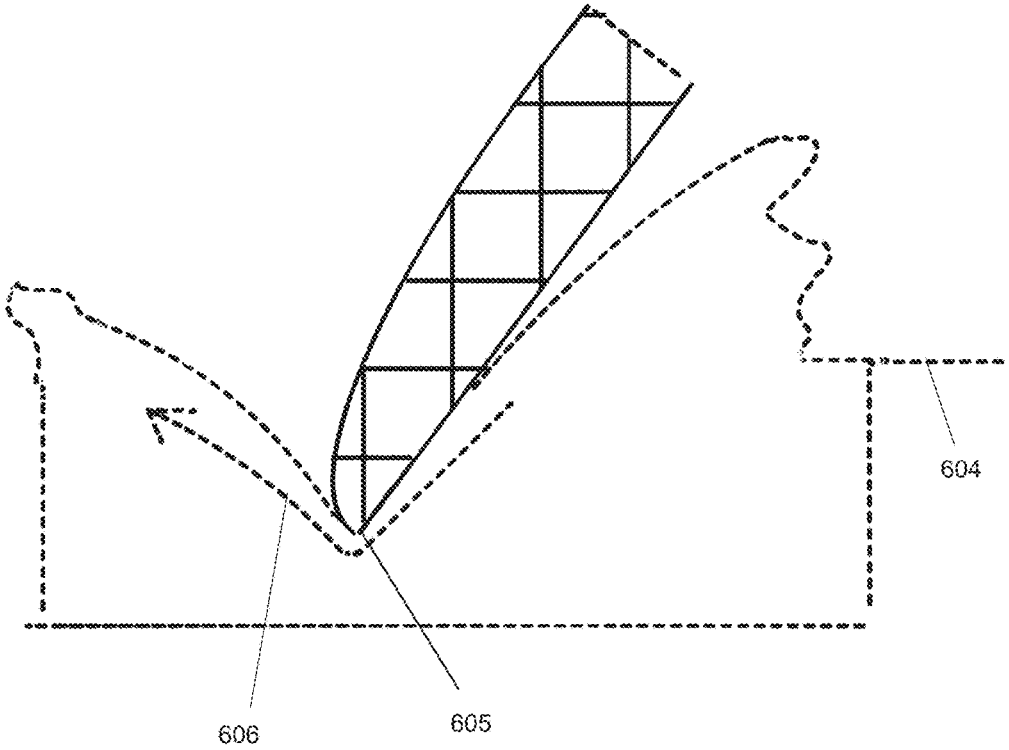

FIG. 6B presents an exemplar of a hard edged rail of a legacy sportsboard, according to some embodiments.

Figure 7:
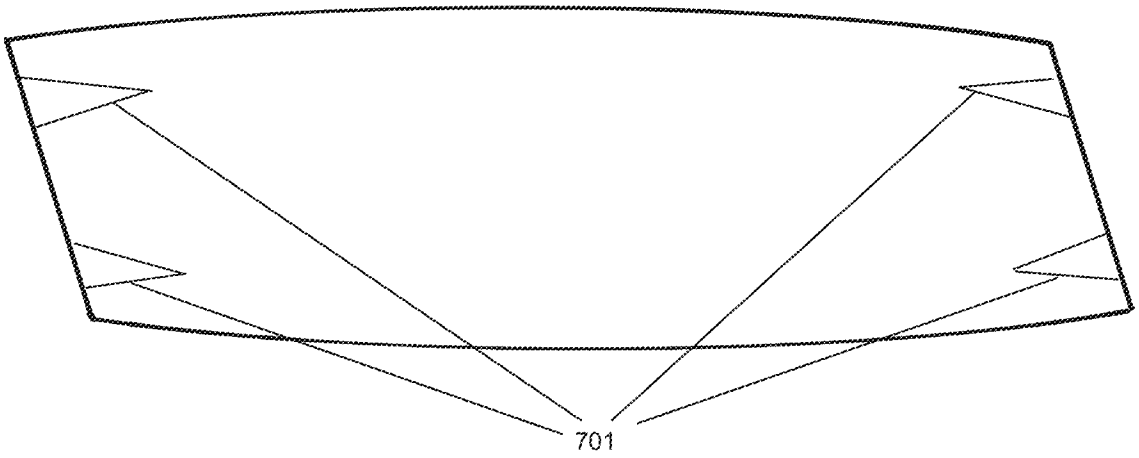

FIG. 7 presents an exemplar of the bottom surface of a regular-foot version of the present disclosure with four traction flutes, according to some embodiments.

Figure 8:
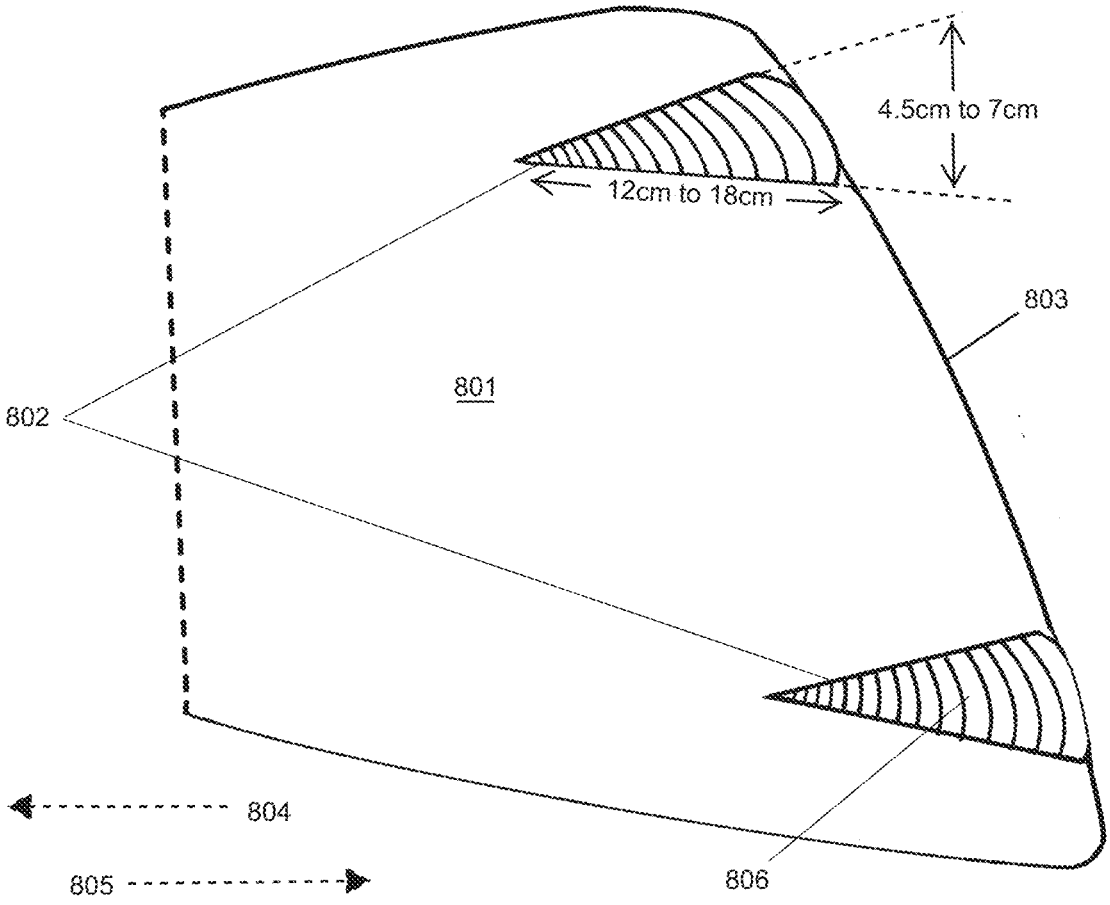

FIG. 8 presents an exemplar of a one half of the bottom surface of a regular-foot version of the present disclosure with a close up view of two of the traction flutes with range measurements, according to some embodiments.

Figure 9:
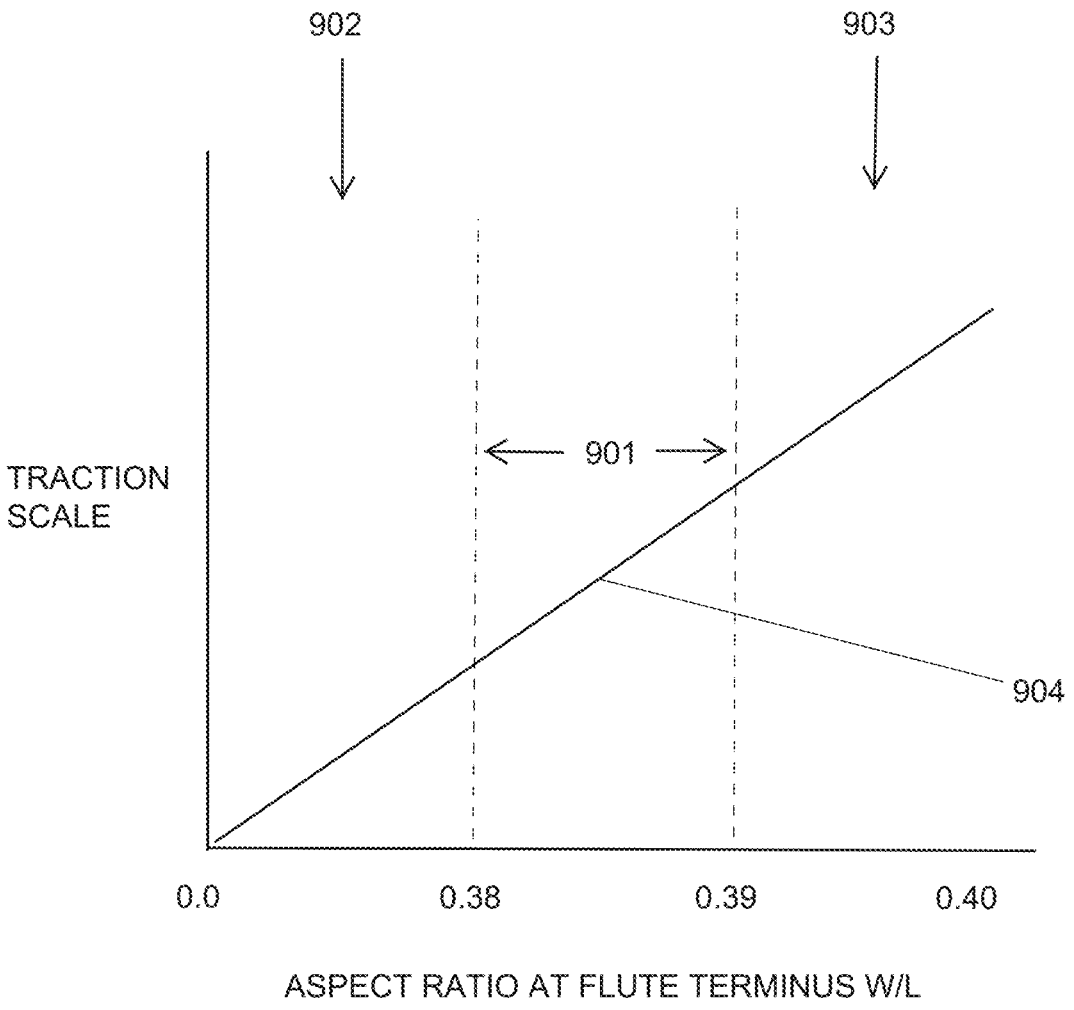

FIG. 9 presents a graph of the range of the traction benefits in reference to the ranges of the optimal aspect ratios of the length of the flutes relative to the optimal aspect ratios of the terminal widths of the flutes, according to some embodiments.

Figure 10A:
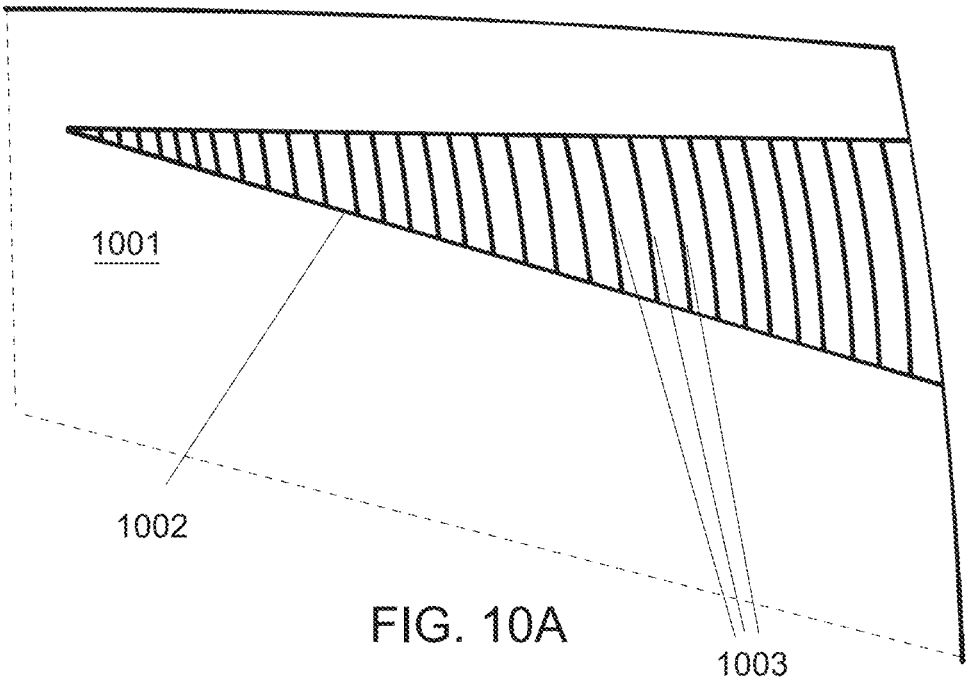

FIG. 10A presents an exemplar of a traction flute with raised directional friction creating elements, according to some embodiments.

Figure 10B:
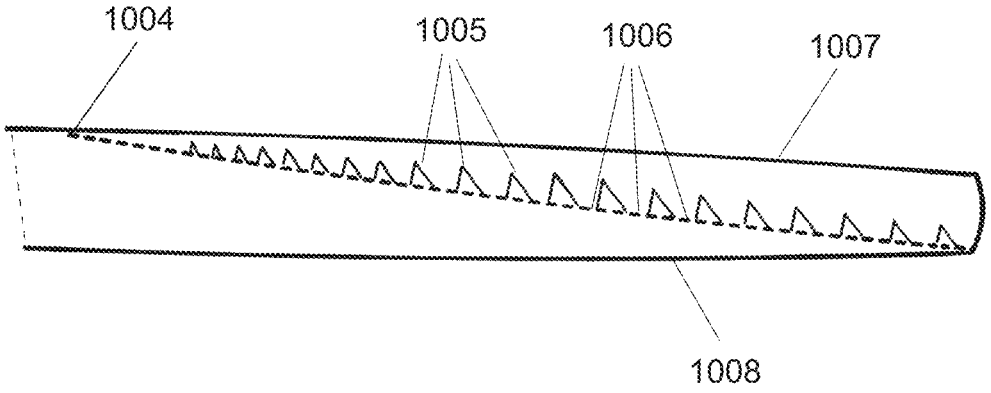

FIG. 10B presents a cross-section view of a traction flute with raised directional friction creating elements, according to some embodiments.

Figure 11A:
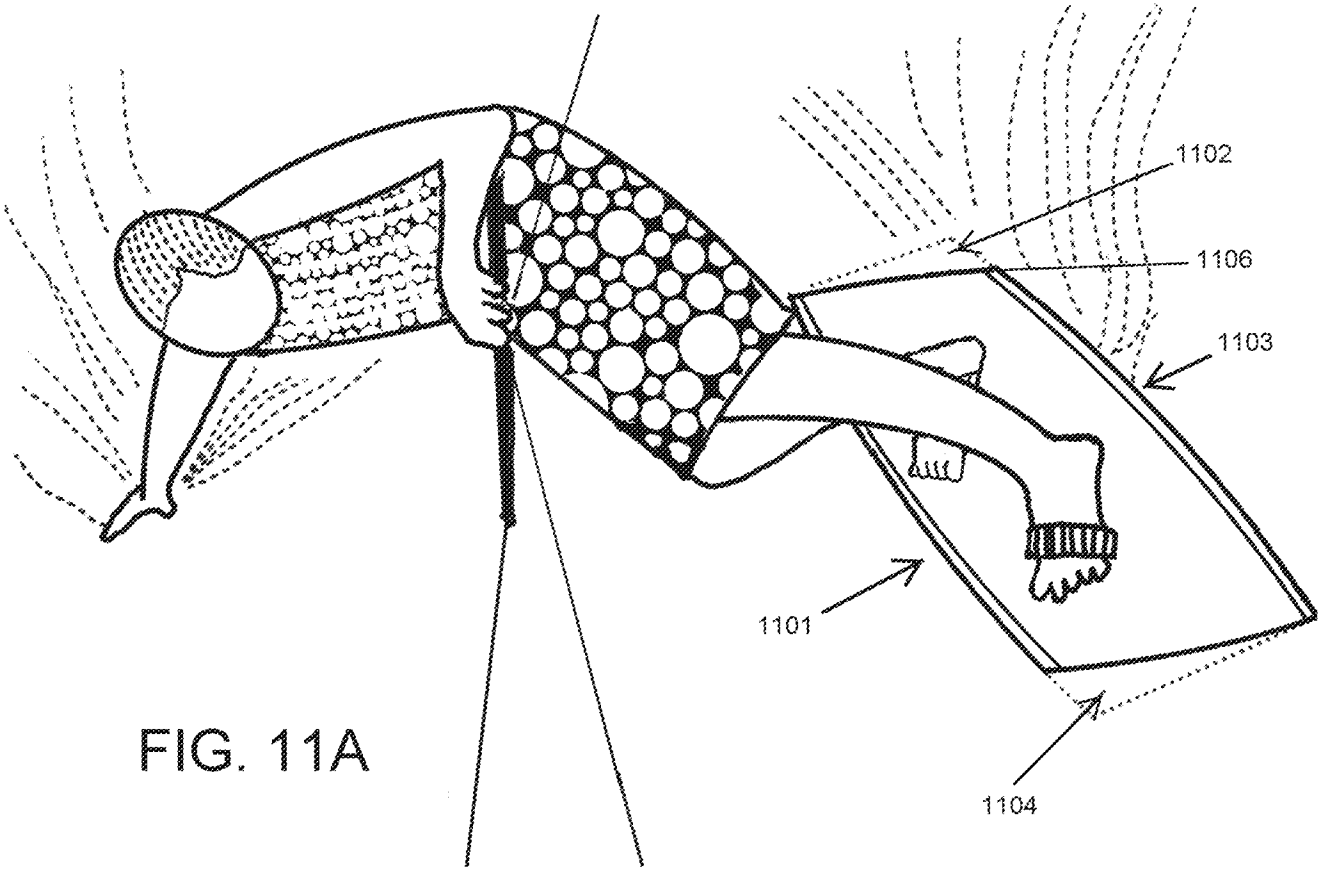

FIG. 11A presents a top-down view of an illustration of a regular-foot, left foot forward kiteboarder performing a toe-side carve or "bottom-turn" on a regular-foot exemplar of the present disclosure.

Figure 11B:
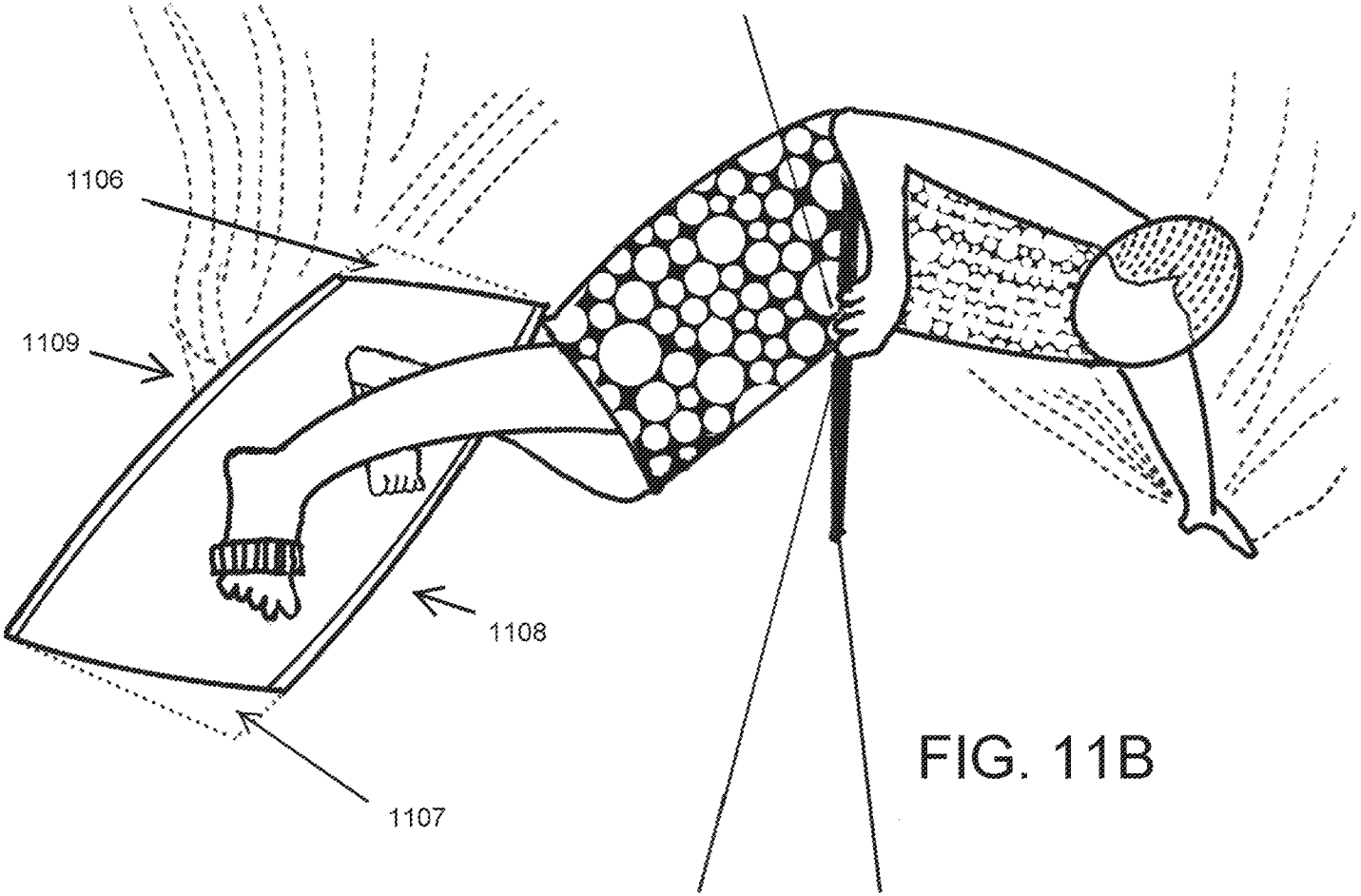

FIG. 11B presents a top-down view of an illustration of a goofy-foot, right foot forwardkiteboarder performing a toe-side carve or "bottom-turn" on a goofy-foot exemplar of the present disclosure.

Figure 12:
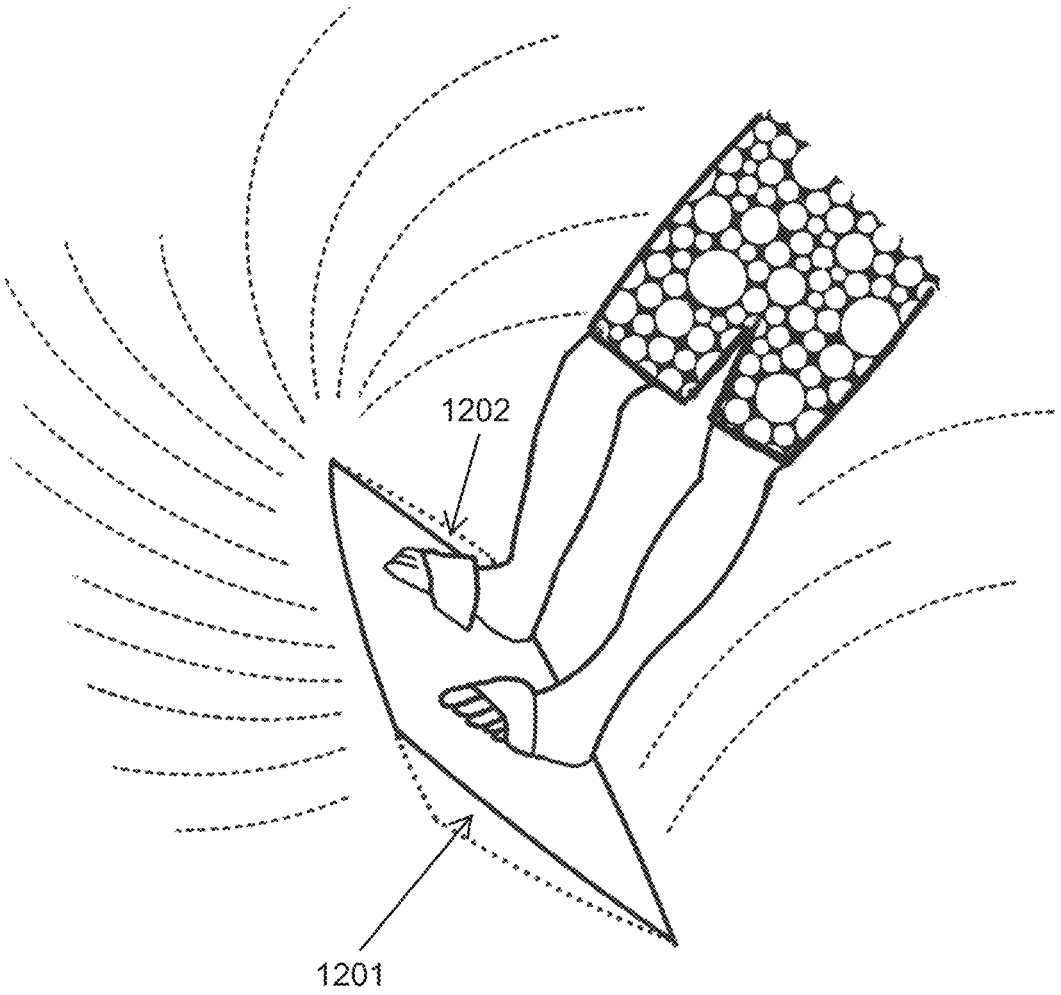

FIG. 12 presents an illustration of a regular-foot sportsboard rider performing a heel-side carve or "cutback" on an exemplar of a regular-foot exemplar of the present disclosure.

Figure 13:
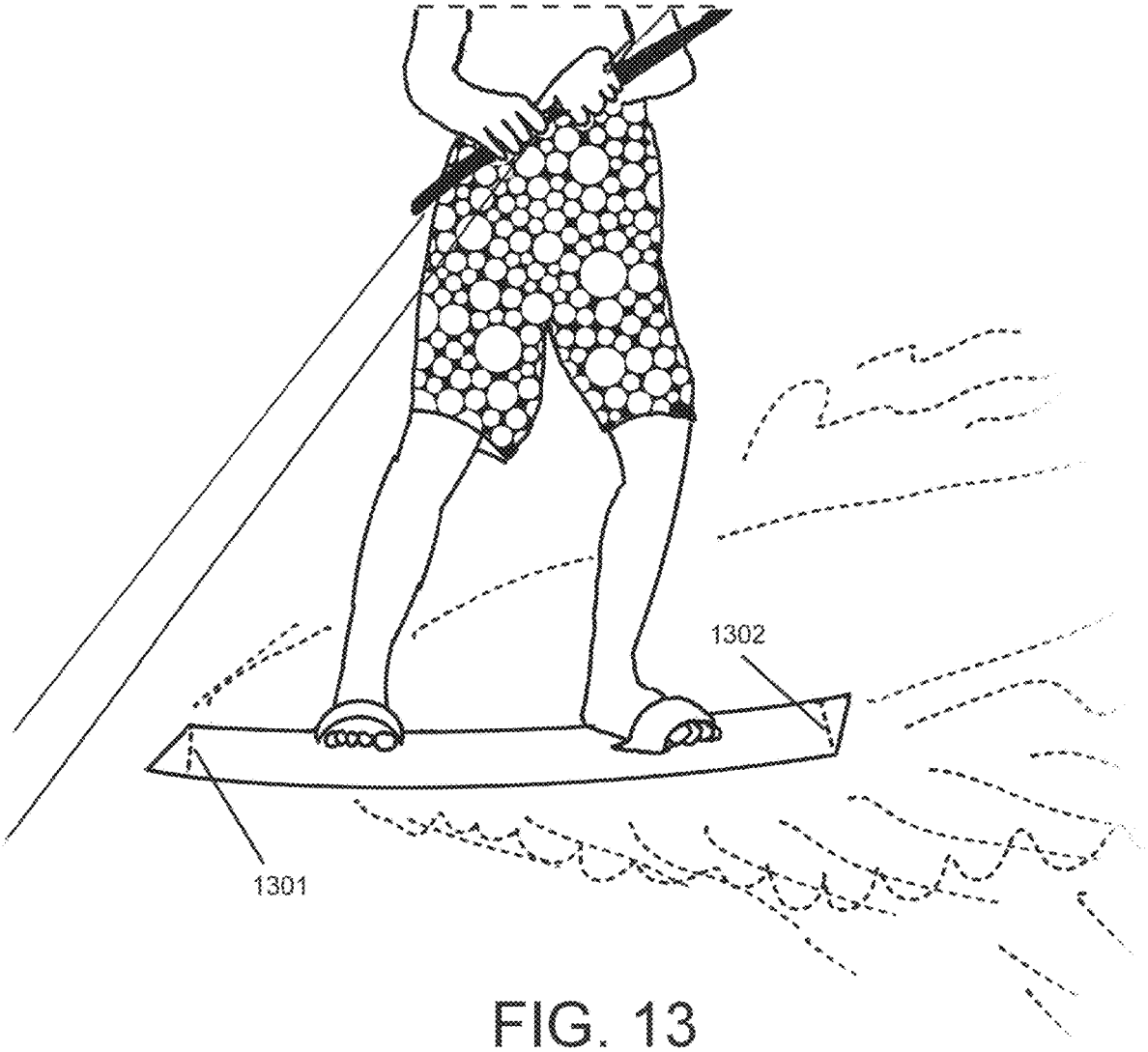

FIG. 13 presents a top-down view of an illustration of a regular foot or left-foot forward kiteboarder sailing upwind with his right foot forward on a left-foot forward exemplar of the present disclosure.

Figure 14:
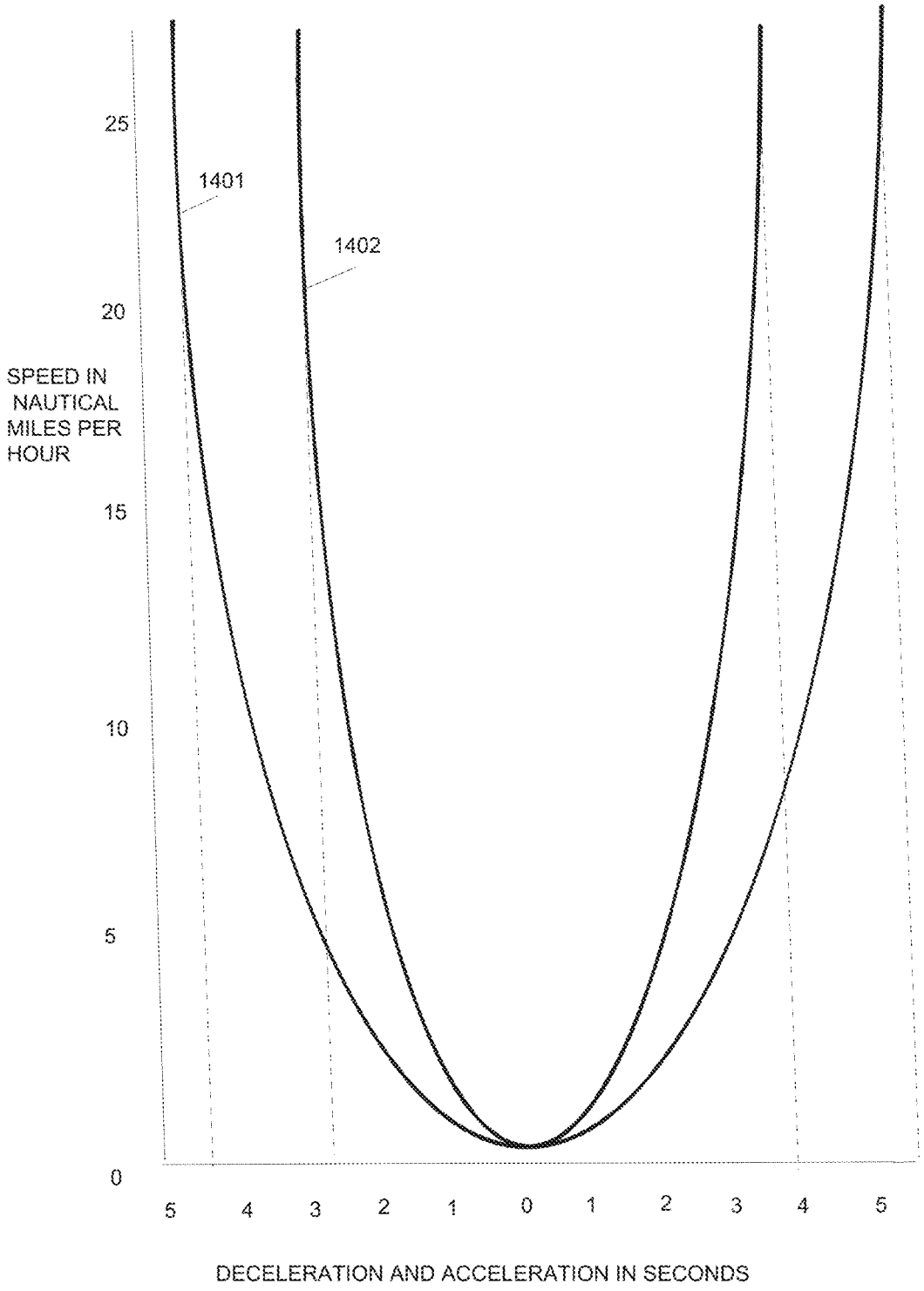

FIG. 14 presents a comparative graph of two deceleration and acceleration arcs through their respective transitions. One is the arc of a legacy sportsboard design and the other is the arc of a sportsboard of the present disclosure.

FIG. 15 presents a three-dimensional representation of a wind window and a kiteboarder performing a traditional transition from starboard to port tack.

FIG. 16 presents a three-dimensional representation of a wind window with a kiteboarder who has performed a power loop and is about to perform a carving maneuver and then accelerate through the power zone.

DETAILED DESCRIPTIONS

According to the present disclosure, a kiteboard, wakeboard, or skimboard rider who rides a stance specific sportsboard will experience greater than expected results because the fore and aft trim and the side to side trim of the board will accommodate their dominant stance, whether their preference is to ride "regular-foot" or "goofy-foot" as they shift from using the toe-side rail to the heel-side rail and vice-versa. This is because the biomechanics of a rider shifts the force of their weight forward and over the toes as the rider leans forward to execute a toe-side carve or bottom turn, and then shifts the force of their weight back and under the back heel when leaning back to execute a heel-side, or cut-back maneuver. The stance accommodating sportsboard and the legacy sportsboards share the expected property of having two rails side by side. However, placing the toe-side rail offset from the heel-side rail in accordance to a rider's dominant stance creates an unexpected property that changes the aforementioned trim of the stance accommodating sportsboard without the need for the rider to move their foot positions.

Because the rails and corresponding edges are offset from each other, the two halves of the bottom surface of the board are also offset from each other, thereby creating asymmetrical planing surfaces and rail ends that are offset from the corresponding planing surfaces and rail ends on the opposite side of the board. This differs substantially from the legacy board designs where both sides are almost always symmetrical. These offset rails serve to accommodate the rider's preferred stance depending on if they are left-foot forward riders (regular-foot) or right-foot forward riders (goofy foot), thereby allowing the rider to have significantly greater control over both the planing surfaces under their feet; and the rails of the board as it slices through the water; whether being towed by a traction kite or other watercraft or while skimming over the water or while otherwise riding on a wave-face. Moreover, this increased rail control is a very significant factor when working in opposition to the lateral pulling force of a traction kite or a towing watercraft.

All sportsboards without a third point of contact with the board like a handhold attached to the board, require a fore and aft stance to maintain stability, in that one foot is placed ahead of the other foot. A "regular-foot" rider stands with his or her left foot ahead or forward of their back foot. A "goofy-foot" rider stands with their right foot forward of their left foot. Thus, the area in front of the front foot of the rider is ahead of the rider, and the area behind the back foot is behind the rider when they are riding in the direction that accommodates their stance, regardless of whether they are a regular-foot rider or a goofy-foot rider.

Additionally, legacy sportsboards rely on sharply defined edges on the rails to repel water and more readily facilitate planing. But these sharply defined edges do not allow for the attachment of water over the rail. Here, in one embodiment, a "softer rail" is illustrated to allow for waterflow over the edge of the rail, thereby creating a more cohesive attachment of water to the rail, which then provides the rider with more control over the sportsboard.

Moreover, the legacy "directional sportsboards" make no accommodation for the weight and force distribution relative to the favored stance of the rider, in that there is generally no difference between the toe-side rail and the heel-side rails of the sportsboards. A directional board has a defined nose and a defined tail, and each half of the board when cut down the centerline is a mirror image of the other side. Thus, a legacy directional board also makes no accommodation for the stance of the rider, in that a regular-foot rider would simply stand with their left foot forward, while a goofy-foot rider would stand on the same board with their right foot forward. Both rails of the board, are symmetrical in that they mirror each other from nose to tail. These "directional outlines" are found ubiquitously on surfboards, skimboards, windsurfers, standup paddle boards, directional wakeboards and directional kiteboards.

Additionally, a legacy dual directional sportsboard also makes no accommodation for the preferred stance of the rider. It has a nose and a tail, and it is also generally symmetrical in that each half of the board down the center line is also a mirror image of the other half. Moreover, most of the legacy dual directional sportsboards are also symmetrical in that each half of the board on either side of a centroid is a mirror image of the other half. Thus, the common name of "twin-tip" is applied to legacy kiteboards and wakeboards of this design since each tip is the identical twin of the other tip. These dual-directional outlines are found almost ubiquitously on all legacy wakeboards and kiteboards.

A narrow exception to this is that there are "asymmetrical" legacy dual directional boards that have a longer rail on the toe side and a shorter rail on the heel side, however, they also make no accommodation for the difference in weight and force distribution between how a regular-foot rider stands and rides, from how a goofy-foot rider stands and rides, since each end of these legacy boards on either side of a centroid is a mirror image of the other end Kitesurfing is closely related to surfing in that the maneuvers performed are closely related to the movements used when riding waves with a surfboard, especially when carving a kiteboard on flat water. The sport of surfing waves has always been the epitome of "cool," hence the adoption and adaptation into our everyday vernacular of the term "surfing the internet." The sports of skateboarding, snowboarding and windsurfing also evolved from wave-surfing, further illustrating the desire of non-surfers to emulate the cool sport of surfing. Then along came the sport of kitesurfing, which now allows anyone with some wind on water, without the need for waves, to emulate the movements and experience similar exhilarating sensations as does a surfer while riding a wave.

The earliest kite surfers used water skis back in the mid 1980's. First with two skis and then using a single ski. Later with the advent of inflatable-leading-edge kites, kiteboarding became more popular, and kiteboarders started riding regular surfboards with foot straps because the two-line kites of the day were difficult to control. Additionally, there was no real ability to de-power the kites, so the kites would sometimes pull the rider off of the board when a gust of wind hit the kite.

Then wakeboarding style twin tip boards were introduced to kitesurfing. The designs were only slightly modified for kiteboarding with a flattened central rocker, to allow them to plane more easily. This was because a traction kite does not generate the low-end raw power that a ski-boat produces. These twin-tip boards were traditionally, and are still contemporarily, ridden with foot straps, or with boots that are attached to the boards, as with snowboarding.

However, these twin-tip boards did not, and do not have the same "coolness" and cachet, or the feel of freedom of movement that is a part of surfing without foot-straps. This is because the riders' feet are locked in position of where the foot-straps or boots are mounted. The inability to trim these boards with feet affixed to the decks of the boards frustrated some riders.

Eventually four-line "delta kites" were invented. These new designs allowed for kites that could be efficiently and quickly de-powered, such that they became much safer to use than the original two-line kites. With the introduction of these delta-shaped kites came the evolution of strapless riding on directional surfboards. The advent of strapless riding allows the rider to move their foot positions to better trim and maneuver the directional boards, as with a traditional surfboard.

However, when riding strapless, significant control over the board is lost that would otherwise exist with the rider's feet in fixed positions attached to the board. Additionally, being attached to a powerful traction kite also inevitably leads to becoming airborne. Only the most athletic, skillful, and experienced riders are capable of riding airborne without foot straps. They accomplish this through an almost intuitive understanding and ability to use the force of the prevailing wind to hold the board against their feet while airborne, or they are able to free a hand while still flying the kite in order to hold onto the board as they fly through the air.

In contrast, the dual direction stance accommodating sportsboard allows a rider to fly through the air and still maintain the most advantageously trimmed stance on top of the board with feet affixed to the deck of the board. This is because the outline of the board now accommodates the rider's dominant stance: specific to their preference as either a regular-foot or with a goofy-foot. All of the foregoing combination of needs is addressed by merely providing a sportsboard with a particular off-set rail outline.

Legacy sportsboards, whether they are "directional" boards, or "dual direction" boards, make no accommodation for the dominant stance of the rider. The need to move the foot positions to properly trim the board under one's feet or the need to hold onto the board as rider is flying through the air is eliminated with the present design; thusly providing greater control, so that the rider can more fully focus on their next maneuver and then aggressively perform the maneuver.

Consequently, the long felt need to have the board trimmed for the next maneuver or while executing the maneuver under greater control is met without the need to shift foot positions from where the feet are affixed to the deck of the sportsboard of the present design.

The drawings described below are for illustration purposes only. The drawings are not intended to limit the scope of the present disclosure. This patent or application file contains at least one drawing executed in color. Copies of this patent or patent application publication with color drawings will be provided to the U.S. Patent and Trademark Office upon request and payment of the necessary fee.

FIG. 1. through FIG. 3. are illustrations of generally rhomboid shaped boards and legacy designs. FIGS. 4A, 4B and 4C. are illustrations of exemplars of more curvilinear shaped boards.

Referring now to FIG. 1A which shows an exemplar of a semi-rigid planar member in the form of a rhomboid shaped sportsboard designed to accommodate the stance of a left foot forward, or "regular-foot" rider with a first end 1A10 and a second end 1A11. When the stance specific dual direction board is traveling in the direction indicated by solid-tip broken-line arrow 1A7, the regular-foot rider's left foot placement location 1A5 is ahead of the right foot placement location 1A6 and the regular foot rider would be in their dominant or preferred stance with their left foot in front of their back foot.

It is clear that the rails are offset in the exemplar in FIG. 1A, in that where a first point 1A1 at where the toe-side rail extends from the first end 1A10 is closer to the centroid 1A9, as shown by distance (broken-line-arrow 1A12) than the distance that the centroid 1A9 is to a second point 1A2 where the toe-side rail terminates at the second end 1A11, as shown by distance (broken-line-arrow 1A13).

The offset rails are additionally illustrated by where a third point 1A3 at where the heel-side rail extends from the first end 1A10 is farther (broken-line-arrow 1A14) from the centroid 1A9 than the centroid is to a fourth point 1A4 (broken-line-arrow 1A15) where the heel-side rail terminates at the second end 1A11. The location at the fourth point 1A4 is the pivot location near the back foot heel of the rider that enables more control in a cutback maneuver than is provided with the legacy designs. The ability for the rider to quickly engage this pivot location without moving their feet is an unexpected benefit over a deficiency in the legacy designs.

Referring now to FIG. 1B. FIG. 1B is an exemplar of the present design, as designed for a goofy-foot rider, who rides with their right foot position 1B9 in front of their left foot position 1B10. Here, the goofy-foot rider is in their dominant stance when riding in the direction shown by broken-line-arrow 1B8. When comparing the exemplars of the present design for the regular foot rider FIG. 1A to the exemplar of the present design for the goofy-foot rider FIG. 1B, it is apparent that the rails on the goofy foot exemplar FIG. 1B are offset, in that corresponding distances between the centroids and the end points are the same as described above.

FIG. 1B, illustrates that where a first point 1B1 at where the toe-side rail extends from the first end 1B5 is closer to the centroid 1B7 than the centroid is to a second point 1B2 where the toe-side rail terminates at the second end 1B6, and wherein where a third point 1B3 at where the heel-side rail extends from the first end 1B5 is farther from the centroid 1B7 than the centroid is to a fourth point 1B4 where the heel-side rail terminates at the second end 1B6.

Now referring to FIG. 1C. Comparing FIG. 1A and FIG. 1B which are exemplars of the present design to the legacy rectangular shaped sportsboard in FIG. 1C, it is readily apparent that the board in FIG. 1C does not have offset rails, in that distance 1C8 is the same as indicated by all of the broken-line-arrows. Thus, riders of the exemplar legacy board do not gain from the unexpected benefits of the offset rail board design of the present disclosure.

Referring back to FIG. 1A, with this regular-foot exemplar, the toe-side rail extends from the first end 1A10, from the first point to where it terminates at the second point where the toe-side rail terminates at the second end 1A11. The heel-side rail extends from the first end 1A10 at the third point 1A3 and terminates at the fourth point 1A4 where it terminates at the second end.

While riding in the direction indicated by solid-tip broken-line arrow 1A7, the first end 1A acts as the nose of the board, and the second end 1A11 acts as the tail of the board. Traveling in this direction, the regular-foot rider would be in their dominant or preferred stance while carving a turn on the toe-side rail, which extends from the first end 1A10 at an initial first point and terminates at a second point where it terminates at the second end 1A11. This allows the rider to put their weight forward and over the front toe-side rail to best bury that rail in a carving turn. See FIG. 11A for an illustration of a regular-foot rider performing a toe-side carve, while power looping and see FIG. 11B for an illustration of a goofy-foot rider carving a toe-side carve.

Back to FIG. 1A, The rider would also be in their dominant stance looking forward and to their left, while doing a cutback on the heel-side rail where it extends from the third point 1A3 at the first end 1A10 to terminate at the fourth point 1A4 at the second end 1A11. With this offset rail, the kiteboarder is now positioned with their back foot placement location close to the pivot location at the terminal point at the end of the heel-side rail, which provides the rider an unexpected benefit of much greater control than is available to a rider of a legacy board (e.g., FIG. 1C)

Comparing FIG. 1A, the present disclosure for a regular-foot board of a rhomboid shape, to FIG. 1C, a legacy rectangular board, it is apparent that the rails on the exemplar in FIG. 1A are offset when compared to the symmetrical rails in FIG. 1C. These offset rails put the rider farther along the toes-side rail than he would be on the legacy board exemplar in FIG. 1C. This puts the rider in forward trim, which also allows the rider to bury more of the toe-side rail into the water as the rider puts their weight and force onto the toes of their left foot placement location 1A5. Because there is also a biomechanical force applied forward and over the front of the toe-side rail, ahead of the centroid 1A9, this also allows the rider to carve more deeply against the lateral pull of a boat or kite, or while surfing; to carve more deeply into the face of a wave.

Conversely, because the heel-side rail is offset in a forward position relative to the toe-side rail while in this direction of travel 1AB, the heel of the rider's back foot placement location 1A6 is also closer to the pivot-point created by the location at fourth point 1A4 at the end of the heel-side rail. This also puts the rider in a trim position towards the second end 1A11, which is the back of the board while traveling in this direction.

This can be contrasted by FIG. 1C, where a regular foot rider traveling in direction indicated by arrow 106 on this exemplar of a legacy board would not have the benefit of having their back foot close to the pivot location at 1C4, which would be the de facto back end of the heel-side rail point 1C3 to point 1C4 The otherwise unexpected benefit over the legacy sportsboard FIG. 1C of having the heel of their dominant right foot closer to the pivot location provides the rider much more control, as the left foot forward rider leans back onto their right heel placement to execute a "backside carve" or other heel-side maneuver, while also changing the trim of their board as if they had moved their back foot closer to the pivot location. Again, FIG. 12 illustrates this maneuver on an exemplar of the present disclosure.

Still referring to FIG. 1A, an additional unexpected beneficial result, that is not available to the rider of the legacy board FIG. 1C, occurs when a left-foot forward kiteboard rider is maneuvering upwind with his/her back to the wind, riding the dual direction board in the direction of travel indicated by arrow 1A8. Under these circumstances, the rider's right foot placement location 1A6 would now be in the forward position on the dual direction sportsboard when traveling in the direction indicated by arrow 1A8, and the rider would now be positioned relatively forward along the heel-side rail, as compared to the foot placement shown on in FIG. 1C in the exemplar of the legacy board, along that heel-side rail point 1C3 to point 1C4.

Referring back to FIG. 1A, the foot placement of this reverse direction (broken-line-arrow 1A8), a position with the rider's force and weight over the right foot placement location 1A6 is now forward (relative to traveling in direction 1A8) along the heel-side rail. This allows the rider to put more weight towards the fourth point 1A4 on the heel-side rail and thus bury that rail deeper in the water, thereby creating more leverage against the lateral pull of the kite. Consequently, this allows the rider to better climb upwind, or to "point" higher into the wind, thereby creating an unexpected benefit that is unavailable to a rider on a legacy sportsboard (illustrated in FIG. 1C). In contrast, when the legacy sportsboard rider is traveling upwind in the direction as indicated by solid-tip broken-line-arrow 1C7, it is apparent that the right foot placement is no closer to the rail end point 1C4 than it is to point 1C2 with the symmetrically aligned rails. Thus, the rider's weight in FIG. 1C is evenly distributed along the heel-side rail, thereby producing no additional benefit.

Referring now to FIG. 1B. FIG. 1B is an exemplar of a reciprocal version of the stance accommodating dual direction sportsboard designed for a goofy-foot or right foot forward rider. All of the unexpected benefits over the legacy design exemplar FIG. 1C, that would be available to the regular-foot rider or left foot forward rider when riding the exemplar board in FIG. 1A would also apply to the goofy-foot rider riding the exemplar board in FIG. 1B Referring again to FIG. 1C, an exemplar of the most common generally rectangular-shaped legacy twin-tip sportsboard. It is readily apparent that because the rails of this shape are symmetrical and not offset from each other the shape makes no accommodation for the unique stance of a rider. The symmetry of the rails is also readily apparent by observing that all of the end points, point 1C1, point 1C2, point 1C3 and point 1C4 are equidistant from the centroid at 1C5. The overall symmetry of the legacy design is also apparent in that the distances from the centroid 1C5 are all of equal length as they run to the end points, point 1C1, point 1C2, point 1C3 and point 1C4.

Unlike with the exemplars of the present disclosure in FIG. 1A and FIG. 1B, whether they are a regular-foot rider or a goofy-foot rider, with a fixed foot, there will be little to no change in trim afforded to the rider of the legacy design FIG. 1C as they shift their weight and force from one rail to the other. The ability to substantially change the trim by switching from one rail to the opposite rail with the offset rails of the present design FIG. 1A and FIG. 1B is not contemplated by the legacy designs FIG. 1C with fixed foot placement locations, and thus, all of the benefits described above are not found with this legacy design.

Referring now to FIG. 2A, this is a left-foot forward or regular-foot exemplar of the stance specific sportsboard with all of the characteristics and unexpected results as described above in FIG. 1A and FIG. 1B. The rails are offset from one another which is clear since the distances 2A3 and 2A2 are longer than distances 2A1 and 2A4. If the rider were to stand with their heels towards the toe-side rail and their toes towards the heel-side rail on this exemplar, it would still be a board designed for a regular-foot, or left-foot-forward rider, because the same outline configuration would apply. This exemplar shows that the outline of the board itself, in which the way the rails are offset from each other sufficiently demonstrates whether this is the regular-foot version or the goofy foot version. Foot placement locations are not needed to make this determination.

To be precise, where a first point 201 at where the toe-side rail extends from the first end 206 is closer to the centroid 205 than the centroid is to a second point 202 where the toe-side rail terminates at the second end 207, and wherein where a third point 203 at where the heel-side rail extends from the first end 206 is farther from the centroid 205 than the centroid is to a fourth point 204 where the heel-side rail terminates at the second end 207.

FIG. 2B is an exemplar of a legacy sportsboard; what is known as an "asymmetrical board" in the kiteboarding industry. Here, the rails are not offset from each other on this legacy sportsboard, which is apparent when observing the rail end distances from the centroid 212. Distances 2B1 and 2B2 are of the same length, showing that the centroid 212 is the same distance from point 208 and point 209 and distances 2B3 and 2B4 are also of the same length, showing that the centroid 212 is the same distance from point 210 and point 211.

Additionally, this legacy design FIG. 2B does not anticipate the difference in the biomechanics of a regular-foot rider, which are distinctly opposite from those of a goofy-foot rider, as in an exemplar of the present disclosure depicted in FIG. 2A. Thus, this legacy "asymmetrical" design does not anticipate the unexpected results and benefits that are available with the present design.

Further, the shape of the legacy asymmetrical board FIG. 2B does not position a rider forward along the toe-side rail where they can fully bury the rail, thereby creating the desired strong counterforce to the lateral pull of a kite or a boat in the same way that the present disclosure in FIG. 2A does. In contrast to the legacy exemplar in FIG. 2B, being positioned forward on the rail, as with the present disclosure FIG. 2A, and sinking more of the length of the rail creates a counter force to the general centripetal force created by the rider when executing a high-speed carve which is not contemplated in the legacy designs shown in FIG. 2B or FIG. 2C for that matter. In fact, with the legacy design of FIG. 2B, the rider, whether a regular-foot or a goofy-foot rider, is positioned disadvantageously farther back than desirable while carving on the toe-side rail.

FIG. 2C is an exemplar of a legacy rectangular dual direction sportsboard with the same limitations as described above in FIG. 1C. It is readily apparent that the rails are not offset from each other, as the rail ends 213, 214, 215, and 216 are all equidistant from the centroid 217 as show by the broken-line-arrows 2C1, 2C2, 2C3 and 2C4, As detailed in the comparisons made between FIG. 1A, FIG. 1B and FIG. 1C the same unexpected results do not apply to this legacy design.

Various techniques for aiding a rider to remain positioned on a sportsboard can be used, some of which are shown and described as pertains to FIGS. 3A. 3B, 3C, and 3D.

Referring now to FIG. 3A, FIG. 3B, FIG. 3C, and FIG. 3D, it can be seen that positioning of the feet of a rider can be configured by aspects of the board and/or the board design itself. For example, a position of a foot of a rider can correspond to a foot placement location that is evident from the board itself and/or its packaging. As used herein, a foot placement location can be defined as an attachment point for straps, or boots, or other foot-bindings. Or a foot placement location can be defined as indentations or pads mounted to specified locations on the deck of a sportsboard. Or a foot placement location can also be inferred from the outline of the sportsboard.

FIG. 3A shows foot placement locations such that length 3A1 is shorter than length 3A2, corresponding to a regular-foot stance in relation to the toe-side rail and the heel-side rail that is optimal for a rider with a dominant left-foot forward or regular-foot stance. Contrastingly, FIG. 3B shows foot placement locations such that length 3B4 is shorter than length 3B3, corresponding to a goofy-foot stance in relation to the toe-side rail and the heel-side rail that is optimal for a rider with a dominant left-foot forward or regular-foot stance. Both FIG. 3A and FIG. 3B demonstrate the offset rails and rhomboid outlines that create the unexpected benefit of greater control that is not anticipated by the legacy sportsboards shown in FIGS. 3C and 3D. Additionally, these exemplars of stance accommodating dual directional sportsboards FIG. 3A and FIG. 3B, show that foot placement locations can also be inferred from the outline of the sportsboard.

Moreover, the depictions of FIG. 3A and FIG. 3B are distinguished from the depictions of FIG. 3C and FIG. 3D. Specifically, neither the sportsboard of FIG. 3C nor the sportsboard of FIG. 3D has offset rails. Accordingly, length 3C5 is the same as length 3C6 length 3D7 is the same as length 3D8. FIG. 3C is an exemplar of a legacy rectangular sportsboard. FIG. 3D is an exemplar of a legacy "asymmetrical" kiteboard.

Referring now to FIG. 4A and FIG. 4B. These two exemplars depict semi-rigid planar members in the form of curvilinear shapes of the present disclosure. With these curvilinear shapes, the same unexpected results as with the rhomboid exemplar apply; in that the weight and force of the rider applied forward and to the toe-side rail, allows the rider to carve more deeply against the lateral pull of a boat or kite, or to carve more deeply into the face of a wave.

Additionally, as with the rhomboid shaped outlines, when the rider is traversing in the opposite direction in their non-dominant stance, this curvilinear design positions the rider farther forward along their heel-side rail, allowing them to sink or bury more of the rail, which thus provides the unexpected benefit of greater windward ability. As with the rhomboid shaped exemplars of the present disclosure, these boards, FIGS. 4A and 4B have a defined toe-side rail that is offset from the heel-side rail.

Referring now to FIG. 4C. FIG. 4C depicts an exemplar of a legacy surfboard or sportsboard design known as a "pintail," with the "wide point forward" as shown by the broken-line-arrow between rail locations at 412 and 413.

The "wide-point" on a legacy symmetrical surfboard is never a specific point, but rather a general location along the outer edges of each of the symmetrical rails where they are farthest from each other. Thus, each of these locations is also a location along each rail that is farthest from a longitudinal central line.

Referring now to FIG. 4C. The widest location along the rail from the longitudinal central line 421 is the approximate location at 412, this is shown by the length of the broken-line-arrow 420. Whether the board is a sportsboard like a surfboard, a paddle board, a windsurfer or a wakeboard the outline would essentially be similar to this exemplar. Unlike the present disclosure, these traditional designs are not dual-directional boards and are designed to be ridden solely in one direction. As such, these boards have a distinct nose section as depicted by the section 414 bounded by the outline and the broken line running horizontally across the board between location 416 and location 418, and a tail section 415 is bounded by the outline and the broken line running horizontally between location 417 and location 419 across the board at that end. These features of a distinct a nose section 414 and a distinct tail section 415 are still ubiquitous in legacy directional sportsboard designs.

With these legacy directional boards the rails start where they extend from the nose section 414 at the approximate location indicated by where the horizontal broken line meets the rails at location 416 and location 418, and then they merge into the tail section 415 at location 417 and location 419, at where the tail section begins to where they converge at the tip of the tail 426.

The distances from location 416 and from location 417 at where the rails begin at the nose and where the rails merge with the tail section at location 418 and location 419 are also indicated by the diagonal broken-line-arrows. These broken line arrows are equidistant from each other and of the same length, which also illustrates that this legacy board design does not have offset rails, which is also quite obvious from the outline; and thus, the exemplar of the legacy board in FIG. 4C is clearly distinct from the present disclosure as shown by FIG. 2A and FIG. 2B.

Further, the foot positions on the legacy board are shown as they would be for a regular-foot rider, a left foot forward rider. Additionally, because of its rail symmetry, this legacy board is designed to work equally well for a goofy-foot rider. Thus, this symmetrical legacy directional sportsboard design does not anticipate the unexpected results and benefits that are available with the present design.

Additionally, as illustrated in FIG. 4C, the rails of the traditional directional boards are equidistant from each other since the board's outline is bilaterally symmetrical, and thus the rider must shift the position of their feet in order to change trim. This exemplar shows the foot positions of where a left-foot forward or "regular foot" rider would place their feet while trimming at speed, or while carving a "bottom turn" on their toe-side rail. When performing a cutback or heel-side maneuver, both feet would be moved farther back to a position closer to the pivot location at very tip of the tail of the board 426.

With the exemplar of the legacy sportsboard shown in FIG. 4C, the widest location 412 along the toe-side rail, as shown by the length of the broken-line-arrow 420 from the longitudinal central line 421, is in front of the front foot of a rider. It has been long understood among surfboard designers that having the widest location along the rail ahead of the rider's front foot provides more bottom surface area which allows the rider to apply the force of their weight forward and directly to the toe-side rail, correspondingly allowing the rider to carve more smoothly and deeply into the face of a wave. Additionally, because FIG. 4C is an exemplar of a traditional directional surfboard with bilateral symmetry, it is designed to be ridden by either a regular-foot rider or a goofy-foot rider, without fixed foot positions. In both situations the widest locations along the rails, location 412 and location 413, remain ahead of the respective front feet of the riders, whether their dominant stance is as a regular-foot or as a goofy-foot.

Referring back to FIG. 4A, an exemplar designed for a regular-foot rider, as with the rhomboid shaped exemplars FIG. 1A and FIG. 2A. The first end 404 or nose section can be distinguished from the second end 405 or tail section, since it is in front of the front foot, which is also the left foot of a regular-foot rider. Thus, this section 404 acts as the "nose" when the board is ridden in the direction where the left foot is leading. When the dual direction board is ridden in the opposite direction, where the right foot is leading, then the second end 405 becomes the nose section and first end 404 becomes the tail section.

Here, the location 427 along the toe-side rail, approximately the farthest from the longitudinal central line 429, as shown by the length of the broken-line-arrow 428 is near the location 401 where the rail merges with the nose section at the first end 404. Thus, the present stance accommodating dual direction board has the same benefit of having the widest location along the toe-side rail forward of the front foot position as with the legacy surfboard illustrated in FIG. 4C; and thus, the same smooth carving style is available to the rider of the present design as there is with the directional legacy surfboard depicted in FIG. 4C.

However, an unexpected benefit that is not available to the rider of the legacy directional board FIG. 4C, is that the offset rails in FIG. 4A and FIG. 4B allow the rider to rapidly change trim position by shifting from one rail to the other without moving their feet. Switching to the heel-side rail on this present design FIG. 4A puts the regular-foot rider's back foot closer to a pivot location 403, which is where the heel-side rail terminates and merges with the tail section at the second end 405. This pivot location 403, is much closer to the heel of the regular rider's dominant right foot, than on the legacy design FIG. 4C where the pivot location at the tip of the tail 426 requires the rider to step back from their forward carving stance to enable a turn off of the pivot location 426 at the end of this board. This need to step back is an unfortunate deficiency in the design of legacy directional boards which has been resolved with the present offset rail design.

Additionally, referring again to FIG. 4A, as with the rhomboid shapes, which end is the first end, or the nose section 404, and which is the second end, or the tail section 405 can be switched, depending on which direction the regular-foot rider rides the board, keeping in mind that the dominant stance of a regular foot is with the left foot forward. As depicted in FIG. 4A, the second end or tail section 405 would become the de facto nose, and the first end or nose section 404 would become the de facto tail section. Further, if the regular-foot rider were to change the direction of the board in FIG. 4A, as stated, then their right foot would become their front foot, which would be nearest location 403, where the heel-side rail meets the de facto nose section (and second end) 405. As explained earlier in reference to the rhomboid shapes in FIG. 4A and FIG. 4B, this position on the curvilinear models creates the same unexpected benefit of better upwind ability, since the rider would be able to more deeply bury the rail against the lateral force of the kite, while the wind is blowing from behind them. The same unexpected benefit would apply to the goofy-foot rider on the board in FIG. 4B.

Referring now to FIG. 4A. The curvilinear offset rail design is shown here. The location 401 where the toe-side rail extends from the first end 404 (or nose section) is closer to the centroid 402 than the centroid 402 is to a second location 423 where the toe-side rail terminates at the second end 423 (the tip of the tail), and where a third location 422 (the tip of the nose) at where the heel-side rail extends from the first end 404 (or nose section) is farther from the centroid 402 than the centroid 402 is to a fourth location 403 where the heel-side rail terminates and merges into the second end 405, at the pivot location where the heel-side rail terminates and merges into the tail section.

Referring again to FIG. 4A: As used when discussing this exemplar and in similar embodiments where the rail meets the pivot location 403, is where the rail terminates. This is where a pronounced curved section extends along the rail behind the rider's back foot to interrupt a more linear flow of the water relative to the forward movement of the board. When a dual direction board is traveling in the direction while the rider is in their dominant stance where the first end is acting as the nose section and the second end is acting as the tail section, the pivot location is at the location 403 along the rail or at the end of the rail, which the rider uses to pivot on when performing a heel-side turn. With the rhomboid shaped exemplars, the terminal end of the rail is very distinct (e.g. FIG. 1A, fourth point 1A4), however, with the curvilinear version the pivot location 403 and thus the terminal location 403 along the heel-side rail is defined by where the rail terminates and merges into the tail section 405.

Referring now to both FIG. 4A and FIG. 4B: because the heel of the rider's back foot is also closer to the pivot-location locations (e.g. FIG. 4A, 403 and FIG. 4B, 410) along the heel-side rails, this unexpected benefit over the legacy sportsboard FIG. 4C with the pivot location 426 at very end of the tail, eliminates the rider's need to move their feet, and the rider need only shift their weight on to their back foot to execute a "backside carve" or heel-side maneuver. Also, as mentioned previously, the present disclosure, as distinguished from the legacy directional surfboard, allows the rider to quickly change trim by switching rails while their feet remain firmly attached to the board.

Referring again now to FIG. 4B, which is the goofy-foot version of the present design. A first location 406 at where the toe-side rail extends from the first end 408 (the nose section) is closer to the centroid 407 than the centroid 407 is to a second location 424 where the toe-side rail terminates at the second end 424, and where a third location 425 at where the heel-side rail extends from the first end 408 is farther from the centroid 407 than the centroid 407 is to a fourth location 410 where the heel-side rail terminates at the second end, where it terminates and merges into the tail section 409.

Referring now to FIG. 5A and FIG. 5B, which are both exemplars of semi-rigid planar members as rhomboid shaped sportsboards designed for a left-foot forward or regular-foot rider. While many kiteboarders emulate surfing maneuvers on the water, such as carving turns, many other kiteboarders are primarily dedicated to "jumping." This is accomplished by utilizing the updraft power of the kite when rapidly changing directions to lift the kiteboarder out of the water. To initiate the jump, many kiteboarders desire a certain flexibility in the board, and they seek boards that provide a certain amount of "pop." This pop is desired to create a momentary controlled resistance against the kite just before being launched into the air. A rough analogy would be the controlled springiness found in a pole-vaulter's pole. This pop is obtained through building a specific springiness into the laminar construction of the board, so that the end of the board has a controlled amount of flex to it (e.g., by selecting a material, a shape of the material, and its juxtaposition into the construction of the board). While other suitable stiffening materials may be used, such as carbon fiber, fiberglass, plastics, and various metals, this stiffening is generally constructed from carbon fiber which is much stiffer than regular fiberglass cloth. As used herein, the term "pop" refers to a pronounced springiness or flexibility in the board as a whole.

However, the legacy designs are fabricated in a manner that only allows flexibility that is uniform horizontally across the board from tip to tip. The present design demonstrates a means of construction wherein the flexibility of the two tips at the same end of the board (e.g., tip 502 and tip 503) may differ from each other so that some "twist" is incorporated into the construction. A board that has "twist" is a desirable aspect in board design when considering the differing stances and preferences of the individual kiteboarders. This is accomplished by inserting a carbon fiber strip, or other stiffening material 501 and FIG. 5B, 504. that is diagonal to the central line. into the laminate. For example, carbon fiber strip 501 is oriented to provide more flexibility at tip 502 than at tip 503. As another example, a carbon fiber strip 504 in FIG. 5B is oriented to provide more flexibility at tip 506 than at tip 505.

As shown in FIG. 5A, the diagonal orientation of the carbon fiber strip 501 allows the kiteboard to have a rail that terminates in a more flexible tip 502 on the toe-side, which may be more desirable for carving maneuvers, and a slightly stiffer tip 503 on the heel-side, which may be desired to create more "pop." In contrast, a more flexible tip 506 on the heel-side may be desirable when combined with a stiffer tip 505 on the toe-side for more resistance when carving toe-side; and this may be created by inserting the carbon fiber 504 in the opposite diagonal arrangement as shown in FIG. 5B.

Both of these illustrations FIG. 5A and FIG. 5B depict left foot forward or "regular-foot" board exemplars with the rails offset accordingly. FIG. 5A shows a carbon fiber strip 501 within the laminate of the board, as with FIG. 5B, which also depicts a carbon fiber strip 502. Because the carbon fiber strips are placed diagonally and depending on their length and width, and the location of their placement, these carbon strips allow for a certain desired "twist" to be incorporated in the design.

By adjusting the placement of these stiffening strips, the present board design can be designed to further accommodate the riders preference depending on whether they are primarily interested in a board that is designed for jumping or if they have a preference for a board primarily designed for carving. For example, FIG. 5A would best suit a rider most interesting in jumping. This is because the carbon fiber strip creates a twist in the flex of the board that stiffens the heel-side rail at the aftmost location (at tip 503) to provide more resistance just prior to the jump. While FIG. 5B illustrates an exemplar wherein the heel-side rail tip would terminate in a more flexible tip 506 because the carbon fiber strip is directed away from that location (e.g., at tip 506). In this position, the carbon fiber strip would stiffen the rail-end on the toe-side rail, thereby creating a different twist to the board.

Referring now to FIG. 6A and FIG. 6B. FIG. 6B depicts a legacy sportsboard rail with a hard edge 605 along the bottom of the rail which causes the water to break away from this edge as the board slices through the water as shown by broken-line-arrow 606. The rail is depicted as penetrating the surface of the water, as shown by horizontal broken line 604, as it slices through the water. As shown, or in a similar form, a hard edge along the bottom of a rail like this is found on almost all of the legacy dual direction sportsboards.

Dual direction wakeboard design was adapted for kiteboarding starting in approximately in the year 1999. Prior to this, traditional directional surfboards with reinforced decks and foot-straps were used for kiteboarding. These dual direction wakeboard designs that were designed to be pulled behind speedboats needed to be only slightly modified by flattening the rocker down the length of the board. This was done so that a board could be pulled onto a plane more easily with a less powerful kite than with a powerboat. These hard edged rails (e.g. 605) on wakeboards had previously evolved from water-ski designs, where these hard edges are necessary to maximize the planing characteristics of these narrow surfaces.

Although this type of hard-edged rail 605 creates a surface that allows the board to more readily plane on top of the water, the drawbacks of these hard edges are that they do not allow for a continued laminar attachment where the water is cohesively attached to the surface of the board as the water flows over the rail, as shown in FIG. 6A by the curved broken-line-arrow 603. In fact, these legacy rails are designed to do the opposite, as is depicted by the direction indicated by the broken-line-arrow 606 in FIG. 6B. The cohesive attraction or attachment of the water is broken by the hard edge 605. The problem with these hard edged rails is that in contrast of what might be expected, they somewhat counterintuitively create less resistance against the lateral pull of a powerful traction kite, because of the abrupt reduction in cohesive attraction of the relative water flow. A softer "50/50" rail 602 as depicted in FIG. 6A, somewhat counter-intuitively, results in more traction and thus gives the rider greater leverage against the pull of the kite. It also provides a more positive connection with the water when transiting through a high-speed carving maneuver. A 50/50 rail is a rail that instead of having a hard edge at the bottom of the rail, the rail is curved evenly, 50/50, towards both the deck and the bottom surface of the board.

In FIG. 6A, a "soft" 50/50 rail edge 602 is depicted on an exemplar of the instant design. The water's surface is indicated by horizontal broken line 601. This soft rail edge 602, which runs for the full length of the rail, allows for a more cohesively attached water flow, as depicted by the curved broken-line-arrow 603 in this exemplar. As stated, this soft rail edge 602 creates a cohesive attraction, and thus a cohesively attached water flow 603 that provides the rider greater traction and thus with much greater control when engaged in carving maneuvers or when leveraging against the lateral pull of the kite while heading upwind. This softer rail edge 602 also allows for a more forgiving edge when the rider is engaged in radical maneuvers where the kiteboard might occasionally be dragged sideways. This is because the softer rail edge 602 will not catch on the water's surface 601 and trip the board, in contrast to the standard legacy hard edged rails (e.g. 605) found on most dual direction kiteboards.

The cohesively attached flow of water 603 over a soft 50/50 rail can also be shown on long surfboards, or "longboards" that are designed for "nose-riding." If one looks closely at a photograph of one of these long surfboards one would notice that the board is positioned "in" the wave where the water is cohesively attached to rail as it flows over on to the deck of the board, rather than a situation where the board rides on top of the water's surface while it is being trimmed in the nose-riding position; as would be the case with hard edges along the bottom of the rail edges. This soft rail as shown in FIG. 6A 602, allows for a much greater cohesive attachment of the water, and in part is what gives the rider the ability to be able to ride out so far on the nose of the board and to "hang-ten" on occasion, without "pearling" the nose, i.e. stabbing it into the water.

Finally, although there are many directional surfboard-style kiteboards available, they do not have 50/50 rails extending along the full length of the rails. This is in part that since the boards are directional with a defined nose and tail, the rails can be shaped so that they are soft near the nose and have hard edges along the bottom in the tail section. Moreover, the hard-edged rails on dual-direction kiteboards exist because most legacy designers cling to the belief that this hard edge is necessary to facilitate planing. Although not depicted here, the planing ability of a sportsboard can be otherwise facilitated through bottom contours, as with certain concaves, so that a hard edge is rendered unnecessary. Thus, the present design of having soft 50/50 rails running the full length of the rails of the dual direction kiteboard provides the unexpected benefit of more traction and thus control, that does not exist with the legacy designs.

Referring now to FIG. 7. FIG. 7 illustrates the positioning of "traction flutes" 701 recessed into the bottom surface area of an exemplar of a stance accommodating dual-direction sportsboard. As used herein, the term "traction flute" refers to a triangular axially extended elongated concave shape that defines a concave groove recessed into a portion of a sportsboard, the concave shape serving to create a frictional coupling between the sportsboard and water. A traction flute initiates from the bottom surface of the board at a zero depth, and gradually gets deeper (e.g., to a depth of 0.5 cm, or to a depth of 1.5 cm) and wider for a specific ratio of length to width until it terminates at the end of the board.

By incorporating these recessed traction flutes instead of fins that would normally be jutting from the bottom surface of a legacy sportsboard, the present design fulfills the long felt need of providing control while overcoming the need for fins. Fins often create undesired friction points with the legacy dual-direction sportsboards, as they are flipped from one end to the other while traversing across the water's surface. Flipping the directional kiteboard from one direction to the other is a commonly practiced maneuver in kiteboarding. Also, when on the face of a wave it is highly undesirable not to have anything jutting from the bottom surface at the nose of a sportsboard.

Notwithstanding, legacy sportsboards without fins have existed, wherein the rail-edges act as the sole means of control in the turns and against the pull of the kite or speedboat. Additionally, finless boards are occasionally used for wave-riding and commonly used for skim-boarding. However, having to rely solely on rail edges, provides for only a limited amount of traction. Whereas the traction flutes 701 provide a similar amount of traction that fins would otherwise provide, without the aforementioned hindrance of creating unwanted friction points.

Referring now to FIG. 8. This exemplar illustrates one half of the bottom surface 801 of an exemplar of the present disclosure. Close up views of two traction flutes 802, with range specifications, showing a length of 12 to 18 cm, and a terminal width of 4.5 to 7 cm are shown as indicated with the solid-line-arrows in centimeters on one of them. Although not clear in this drawing, these traction flutes have rounded edges which allows the relative flow of water across the bottom surface of the board to remain cohesively attached to the surface as the water-flow transitions from the flat bottom surface of the board into the flutes when the board is traveling in the direction indicated by broken-line-arrow 804. This is akin to the cohesive attachment of the water flow over the rails as describe above in reference to FIG. 6A. The shape of these recessed traction flutes result in a progressively increased variance from zero to a defined ratio of a width and depth at the terminus of the flutes at edge 803, as the board travels in the direction indicated by broken-line-arrow 804. This water-flow results in a gradual increase in the wetted surface areas within the flutes to which the water is cohesively attached, which generates localized traction. Additionally, in some embodiments, the area within these traction flutes as indicated 806, may comprise raised directional friction creating elements to further increase the wetted surface area.

Prior attempts to produce traction between the board and the water have relied on channels with increasing depth over a considerable length of the boards. However, the mere provision of channels with increasing depth fail to provide optimal traction. What is needed, and as shown in the flutes of FIG. 8 are traction flutes 802 that are configured into an aspect ratio between width of the flute and length of the flute such that during operation the optimal amount of traction is provided. Prior attempts have failed to identify that varying all three dimensions of the shape of the channels could be configured to result in the optimal amount of traction.

Referring again to FIG. 8. When the dual direction board is traveling in the opposite direction as indicated by broken-line-arrow 805, these traction flutes 802 will actually generate some lift, since the water is "compressed" as it flows from the wider end of the flute to the narrower end. This creates an unexpected benefit that can help accentuate a carving turn when the full rail of the dual-direction stance accommodating sportsboard is immersed, and the traction flute generates some lift while acting as a "scoop." See also examples of both a regular foot rider in FIG. 11A and a goofy-foot rider in FIG. 11B which depicts riders carving on their toe-side rails. Another unexpected benefit of riding the traction flute in the opposite direction as indicated by broken-line-arrow 805, is that the flute will generate lift such that it has also creates some increased windward ability if the rail is fully buried under water. See also FIG. 13 which illustrates a regular-foot rider sailing to windward in that configuration.

Referring now to FIG. 9 depicting a graph showing a traction scale on the X axis and numerical measurements ranging from 0.0 through 0.38, and 0.39 to 0.40 on the Y axis. Specifically, varying the width of the flute with respect to the length of the flute has an aspect ratio of the flute corresponding to the variance. These aspect ratios correspond to the lower range of the width divided by the lower range of the length resulting in a ratio of 0.38 and the higher range of the width divided by the higher range of the length resulting in a ratio of 0.39. As shown in the graph in FIG. 9, there exists an optimal range 901 for the aspect ratio of the flute, as depicted, between where diagonal line 904 intersects with broken line extending above 0.38 and the broken line extending above 0.39.

Further, FIG. 9 illustrates the criticality of certain ranges of dimensionality of the flutes. The critical range of the aspect ratio of 0.38 to 0.39 is shown by optimal range 901. Now referring back to FIG. 8, the range for the length of the traction flute is between 12 centimeters to 18 centimeters, with a terminal width ranging from 4.5 cm to 7 cm. This corresponds to the aforementioned aspect ratio range from 0.38 to 0.39. As illustrated, arrow 902 indicates a zone of insufficient traction below aspect 0.38, while arrow 903 indicates a zone of too much traction, above aspect 0.39, thus creating undesirable drag.

This optimal range 901, is critical since it achieves unexpected results relative to the aforementioned prior art range in the use of relatively long channels. Specifically, that traction flutes shaped within this range create friction in a very localized area that result in unexpectedly beneficial localized traction in these areas on the board's bottom surface. These traction flutes provide the rider with control that has heretofore only been achieved with legacy sportsboards through the use of fins jutting orthogonally from the bottom surface. As stated, these fins often create undesired friction points while flipping the board from end to end, or while riding on a wave face.

Referring now to FIG. 10A and FIG. 10B. FIG. 10A depicts an exemplar of a traction flute 1002 on the bottom surface 1001 of one end of the board. This traction flute contains raised directional friction creating elements on the surface area of the traction flute 1002 consisting of directionally oriented concentric angled ridges 1003 that run across the width of the traction flutes. FIG. 10B illustrates that these ridges 1005 extend from the surface area of the flute 1006 and are angled towards where the flute begins at the zero location 1004 on the bottom surface 1007 of the sportsboard (See also FIG. 10A, 1001). The deck of the board is shown by solid line 1008 in FIG. 10B. Although these figures depict ridges, this additional directional traction may also be achieved through the application of numerous and varied directional friction creating elements jutting from the surface of the traction flutes creating directional friction, that may, for example, resemble the directional placoid scales found on almost all shark species. Or, for example, they may resemble the directional spines on a puffer fish, when not extended. Additionally, they may be of a flexible material or consist of some flexible or hinged portions so that they increase their friction, and thus the traction of the flutes when traveling in the direction where traction is desired, but then reduce their friction when lying against the surface when the board or planing surface is traveling in the direction where lift, but not traction is desired.

Referring now to FIG. 11A. FIG. 11A depicts a left-foot forward or "regular-foot" rider performing a "bottom turn" or carving maneuver on the toe-side rail 1101 of an exemplar of the present design while kiteboarding. The kite control bar is attached to a waist harness, and the rider is dragging his right hand in the water, as he carves the turn. The sections, section 1102 and section 1104 as indicated within the broken lines are sections that would be present if this was a legacy rectangular dual direction sportsboard.

Apparent in this illustration of the present design, is that the toe-side rail 1101 is offset from the heel-side rail 1103, which puts the rider's fixed foot positions forward along the toe-side rail 1101. This provides for a forward-trimmed position while on the toe-side rail 1101, and a position closer to the pivot point 1106 at the end of the heel-side rail 1103. As previously described, because of the ability to substantially change fore and aft trim by switching rails, even with feet in fixed locations, these offset rails provide the rider with the unexpected benefit of much greater control than would otherwise be available on a legacy sportsboard that makes no accommodation for the rider's dominant stance, whether they be a regular-foot, as illustrated, or a goofy-foot, as depicted in FIG. 11B.

Referring to FIG. 11B which depicts a right-foot forward or goofy foot rider engaged in a carving toe-side maneuver. As in FIG. 11B, the section 1106 and section 1107 bounded by the broken lines indicate the sections that would exist if this were a legacy dual direction sportsboard. The toe-side rail 1108 is offset from the heel-side rail 1109 in the opposite direction from how the rails shown in FIG. 11A are offset from each other on the exemplar designed for the regular-foot rider, thereby creating an outline that accommodates the dominant stance represented here, that of a goofy-foot rider.

Referring now to FIG. 12. FIG. 12 is a downward view of the lower half of a rider on a stance accommodating sportsboard while performing a "cutback" or heel-side carve. The sections bounded by the broken lines at section 1201 and section 1202 depict sections that would exist if this was a legacy rectangular-shaped board with symmetrical rails that are not offset from each other. The rhomboid shape of this embodiment show that the rider is closer to the pivot location at the back of the rail on his heel-side, which is directly behind the right heel of the rider, than where the rider would otherwise be positioned on a legacy sportsboard. This affords the rider the unexpected benefit of much greater control than a legacy rectangular board would provide during this maneuver.

Referring now to FIG. 13. FIG. 13 is a downward view depicting the lower half of a left-foot forward kiteboarder, who has flipped the board around to where he is riding in the right-foot forward position. This is done to maximize the ability to ride up-wind by putting more of the heel-side rail into the water against the lateral pull of the kite. The broken lines 1301 and 1302, show where the ends of a legacy rectangular kiteboard would terminate. Here, the rhomboid shape as depicted by the solid outline of the presently disclosed sportsboard with offset rails, puts the rider forward on the heel-side rail. This provides the unexpected benefit of allowing the rider to bury or sink more of the rail than he or she would on a legacy board, thereby providing more upwind resistance against the lateral pull of the kite.

Referring now to FIG. 14. FIG. 14 is a graph showing a scale of speed in knots per hour on the X axis at intervals of 5 knots per hour showing deceleration from about 20 knots, to 15 knots, to 10 knots, to 5 knots and close to 0; and then acceleration speed up to about 25 knots, and time measurements in seconds on the Y axis. FIG. 14 is a graphical representation of the deceleration and acceleration of a legacy symmetrical kiteboard, represented by arc 1401 as compared to the deceleration and acceleration of the offset rail kiteboard, represented by arc 1402. The legacy designs, especially where the rider's feet were in fixed positions are deficient in that they do not allow for a substantial change of trim by just switching from rail to rail.

In contrast, because the present design accommodates the rider's preferred or dominant stance, it provides the rider the unexpected benefit of greater control, thereby allowing more rapid deceleration and then greater acceleration out of a transitional maneuver; whether the carving maneuver is performed on the toe-side rail or on the heel-side rail. Here, arc 1401 represents deceleration by the legacy design dual direction kiteboard from 20 knots to close to zero, which does not represent a stationary point, but rather a point where the transition occurs, and then the same continuous arc 1401 represents acceleration in the opposite direction up to about 25 knots per hour. As shown, arc 1402, which represents the present design, allows the rider the unexpected benefit of both decelerating, and then accelerating, while carving through a transition at substantially greater speeds.

Additionally, in this graphic exemplar in FIG. 14, the broken lines indicate the approximate speed for the legacy design dual direction kiteboard (arc 1401) to go from approximately 20 knots in 4.5 seconds to the zero point, and then accelerating to approximately 25 knots in 5.5 seconds. Arc 1402 represents the present design decelerating from approximately 20 knots in 2.75 seconds and accelerating to approximately 25 knots in 4 seconds.

Comparing these relative arcs illustrates the greater carving speeds produced when a rider is confidently riding the present design, which accommodates the biomechanics of their stance, regardless of whether they are a regular-foot or a goofy-foot; than when they are riding a legacy sportsboard which must accommodate both regular-foot riders and goofy-foot riders. This confidence is needed when harnessing the tremendous power generated by the gravity-accelerated kite when "power-looping." Carving at speed on either toe-side or heel-side rail provides the rider with the unexpected benefit of greater control, and thus allows the rider to ride more aggressively and to experience greater exhilaration than what is currently available with the legacy designs.

Referring now to FIG. 15. FIG. 15 is an exemplar of a legacy kiteboarder performing a traditional transition. Here, the traction kite is shown as flying on two lines for simplicity, while in actuality the modern leading-inflatable-edge kites generally are flown on four lines. The "wind window" is depicted as a half-sphere by broken lines. The true wind direction is shown as indicated by the large arrow. The kiteboarder is depicted traveling on starboard tack. The deepest part of the half-sphere is known as the "power zone," because when the kite is flown horizontally across that area, the kite generates the maximum lateral force. Most kiteboarders fly their kites at approximately a forty-five-degree angle, thereby generally avoiding the power zone. Then when they want to transition to the opposite direction, as in from starboard tack to port tack as is shown in the exemplar, they will fly the kite upwards and along the edge of the wind window in the direction depicted by the broken-line-arrow. As this occurs, the kite is traveling against the force of gravity which slows down the apparent wind and generally reduces power, and since it is at the edge of the wind window it is also far from the power zone. This results in a relatively slow board speed through the transition. The broken-line-arrow indicates the arc of this kiteboarder's transition.

However, if a kiteboarder performs this type of transition while traveling at high speed, then as the kite pulls upward in the opposite direction, they will "jump" as the kite pulls the rider skyward. Many kiteboarders are afficionados of "jumping" with their kite, and there are international contests where riders will compete to see who "jumps" the highest.

Referring to FIG. 16. FIG. 16 is an exemplar of a kiteboarder performing a power loop transition. Here, the traction kite is shown as flying on two lines for simplicity, while in actuality the modern leading-inflatable-edge kites generally are flown on four lines. As in FIG. 15, the half-sphere that is the wind window is illustrated in this exemplar. However, here the kiteboarder has swooped the kite towards the water, as indicated by the broken-line-arrow showing the recent path of the kite. During this power loop transition, in contrast to a traditional transition FIG. 15, the kite is accelerated by both the forward movement of the rider, and the force of gravity. The kiteboarder is still moving forward as indicated by the broken-line-arrow in front of the kiteboarder, but the kiteboarder is about to be pulled through a high-speed turn as the kite flies horizontally from one side of the wind window through the power zone as indicated. This power loop technique creates tremendous power and requires much greater board control than a legacy symmetrical kiteboard design provides. Thus, the unexpected benefits provided by a stance accommodating kiteboard are necessary for the confident execution of a power loop transition. If this were a goofy-foot rider, they would likely carve a high-speed transition along the route as shown by the broken arrow in front of the kiteboarder, and the illustrated board would be a rhomboid shape opposite to what is illustrated. However, if a left-foot forward rider is being illustrated in this exemplar, this is the stage where the kiteboarder would quickly need to switch ends on the board to bring his or her left foot to the forward position into their dominant stance to perform a heel-side "cutback."

This is where the aforementioned "traction flutes" (as shown in FIGS. 7, 8, 9 and 10) allow the rider to flip the board around without the hindrance of fins jutting from the bottom surface and creating unwanted drag points. This is another unexpected benefit of the present design over a previous deficiency in the legacy symmetrical kiteboards with fins. Most of the legacy dual direction kiteboards have four fins, which can create many unwanted drag or catch-points when flipping a board from end to end.

What is claimed is:

1. A dual direction stance accommodating sportsboard comprising:

a semi-rigid planar member having a first end and a second end, and having a bottom surface and a deck, the deck having a centroid, and the semi-rigid planar member having a toe-side rail offset from a heel-side rail; and a traction flute that defines at least one triangular axially extended elongated concave groove;

wherein the toe-side rail extends from a first point at the first end to a second point at the second end and the heel-side rail extends from a third point at the first end and terminates at a fourth point at the second end, wherein where the first point is closer to the centroid than the centroid is to the second point, and wherein where the third point is farther from the centroid than the centroid is to the fourth point.

2. The dual direction stance accommodating sportsboard of claim 1, wherein at least one of the rails is rounded.

3. The dual direction stance accommodating sportsboard of claim 1, wherein the first end has at least one traction flute on the bottom surface and the second end has at least one traction flute on the bottom surface.

4. The dual direction stance accommodating sportsboard of claim 1, wherein surface areas within at least one traction flute comprises of at least one raised directional friction generating element.

5. The dual direction stance accommodating sportsboard of claim 1, wherein portions of or all of the semi-rigid planar member are constructed from at least one of, carbon fiber, fiberglass, plastic, or metal, wherein the semi-rigid planar member is disposed to alter flexibility longitudinally from the first end to the second end, and to alter flexibility latitudinally across from where the toe-side rail terminates at the second point, across to where the heel side rail terminates at the fourth point.

6. The dual direction stance accommodating sportsboard of claim 1, wherein a carbon fiber strip or a stiffening material runs lengthwise and diagonally through the semi-rigid planar member.

7. A method for manufacturing a dual direction stance accommodating sportsboard, the method comprising:

providing a semi-rigid planar member having a first end and a second end, and having a bottom surface and a deck, the deck having a centroid, and the semi-rigid planar member having a toe-side rail offset from a heel-side rail; and providing a traction flute that defines at least one triangular axially extended elongated concave groove;

wherein the toe-side rail extends from a first point at the first end to a second point at the second end and the heel-side rail extends from a third point at the first end and terminates at a fourth point at the second end, wherein where the first point is closer to the centroid than the centroid is to the second point, and wherein where the third point is farther from the centroid than the centroid is to the fourth point.

8. The method of claim 7, wherein portions of or all of the semi-rigid planar member are constructed from at least one of, carbon fiber, fiberglass, plastic, or metal such that flexibility differs longitudinally from the first end to the second end, and differs latitudinally across from the second point where the toe-side rail terminates to the fourth point where the heel-side rail terminates.

9. The method of claim 7, wherein a carbon fiber strip or a stiffening material runs lengthwise and diagonally through the semi-rigid planar member.

10. The dual direction stance accommodating sportsboard of claim 1, wherein portions of or all of the semi-rigid planar member are constructed from at least one of, carbon fiber, fiberglass, plastic, or metal, wherein the semi-rigid planar member is disposed to alter flexibility longitudinally from the first end to the second end, and to alter flexibility latitudinally from the first point from where the toe side rail emerges across to the third point from where the heel side rail emerges.

11. The dual direction stance accommodating sportsboard of claim 1, wherein the traction flute has a recessed shape corresponding to a progressively increased variance from zero to a defined ratio of a width and a corresponding depth.

* * * * *